US010694856B2

(12) United States Patent
Claypoole

(10) Patent No.: US 10,694,856 B2
(45) Date of Patent: Jun. 30, 2020

(54) FURNITURE WITH INTEGRATED STORAGE COMPARTMENTS

(71) Applicant: Jami Claypoole, San Juan, PR (US)

(72) Inventor: Jami Claypoole, San Juan, PR (US)

( * ) Notice: Subject to any disclaimer, the term of this patent is extended or adjusted under 35 U.S.C. 154(b) by 0 days.

(21) Appl. No.: 15/962,532

(22) Filed: Apr. 25, 2018

(65) Prior Publication Data

US 2019/0116983 A1 Apr. 25, 2019

Related U.S. Application Data

(60) Provisional application No. 62/489,940, filed on Apr. 25, 2017.

(51) Int. Cl.

| | |
|---|---|
| ***A47C 1/024*** | (2006.01) |
| ***A47C 1/14*** | (2006.01) |
| ***A47C 7/18*** | (2006.01) |
| ***A47C 7/62*** | (2006.01) |
| ***A47C 31/11*** | (2006.01) |
| ***A47C 11/00*** | (2006.01) |

(52) U.S. Cl.

CPC ..... *A47C 7/628* (2018.08); *A47C 1/143* (2013.01); *A47C 1/146* (2013.01); *A47C 11/00* (2013.01)

(58) Field of Classification Search

CPC ..... A47C 7/628; A47C 1/143; A47C 1/146; A47C 11/00

USPC ..... 297/188.04, 188.07, 188.09, 188.1, 297/354.13, 188.05, 188.06, 188.08, 297/188.11, 188.12, 188.13, 219.1–229, 297/118

See application file for complete search history.

(56) References Cited

U.S. PATENT DOCUMENTS 1,325,630 A * 12/1919 Fair ..... A47C 1/023 297/188.07 X
2,696,870 A * 12/1954 Mende ..... A47C 7/407 297/188.1 X
2,812,227 A * 11/1957 Hill ..... A47B 69/00 297/188.1
3,498,214 A * 3/1970 Bailey ..... A47C 16/02 297/188.1 X
3,623,683 A * 11/1971 Bennett ..... B64D 11/00 297/188.11 X
4,248,476 A * 2/1981 Phelps ..... A47C 13/00 297/118
4,474,407 A * 10/1984 Nazar ..... A47C 1/146 297/188.01 X
4,527,830 A * 7/1985 Meyers ..... A47D 11/002 297/188.09 X
4,650,245 A * 3/1987 Nazar ..... A47C 7/72 297/188.01
4,652,048 A * 3/1987 Nazar ..... A47C 7/62 297/188.01
4,738,217 A * 4/1988 Smith ..... B63B 29/04 297/118 X
4,883,317 A * 11/1989 Davenport ..... A47C 7/62 297/188.1
5,597,201 A * 1/1997 Hinze ..... B60N 2/32 297/188.1 X
5,622,404 A * 4/1997 Menne ..... A47C 4/52 297/188.1
5,727,844 A * 3/1998 O'Quinn ..... A47C 3/16 297/188.09 X (Continued)

*Primary Examiner* — Rodney B White
(74) *Attorney, Agent, or Firm* — One LLP; Joseph K. Liu

(57) ABSTRACT

Systems, devices, and methods are provided for furniture with integrated internal storage chambers that are sealable and operable to contain items.

9 Claims, 25 Drawing Sheets

(56) References Cited

U.S. PATENT DOCUMENTS 6,283,059 B1 * 9/2001 Scully, Jr. ..... B63B 29/04 297/118 X
6,341,817 B1 * 1/2002 Stern-Gonzalez ..... A47C 3/16 297/188.09
6,367,873 B1 * 4/2002 Dorner ..... A47C 17/161 297/118 X
6,585,316 B2 * 7/2003 Kucera ..... B63B 29/04 297/188.07 X
6,929,321 B1 * 8/2005 Shrock ..... A47C 17/80 297/188.09 X
7,559,602 B2 * 7/2009 Ward ..... A47C 3/16 297/188.04
7,604,290 B1 * 10/2009 Giordano ..... A47C 3/32 297/188.09 X
8,056,978 B2 * 11/2011 Shivers ..... B60N 2/0284 297/118 X
8,262,159 B2 * 9/2012 Daniels, Jr. ..... B60N 2/24 297/188.09 X
8,740,300 B2 * 6/2014 Daniels, Jr. ..... A47C 7/62 297/188.09 X
8,998,327 B2 * 4/2015 Cooney ..... B63B 29/04 297/188.1
2003/0230912 A1 * 12/2003 Arnold ..... A47C 5/04 297/158.3
2006/0249998 A1 * 11/2006 Westendorf ..... A47C 17/86 297/188.1
2007/0188000 A1 * 8/2007 Schwartz ..... A47B 83/00 297/188.1 X
2007/0222261 A1 * 9/2007 True ..... A47C 3/16 297/188.1
2008/0157571 A1 * 7/2008 Richardson ..... A47C 4/02 297/188.1
2012/0086243 A1 * 4/2012 Daniels, Jr. ..... B25H 3/02 297/188.09
2012/0242116 A1 * 9/2012 Desnoyers ..... A47C 7/543 297/220 X
2015/0130233 A1 * 5/2015 Thuma ..... B29C 49/0031 297/188.1
2015/0259049 A1 * 9/2015 Chen ..... B63B 17/00 297/188.1
2015/0272336 A1 * 10/2015 Abelmann ..... A47C 11/00 297/188.07
2016/0000228 A1 * 1/2016 Restrepo ..... A47C 7/62 297/188.1
2016/0166067 A1 * 6/2016 Tanaka ..... A47C 7/543 297/219.1

* cited by examiner

Lounge Chair

ELEVATION A

ELEVATION B

700E

FURNITURE WITH INTEGRATED STORAGE COMPARTMENTS

CROSS-REFERENCE TO RELATED APPLICATIONS

This application claims priority to U.S. Provisional Application No. 62/489,940, filed Apr. 25, 2017, which is incorporated herein by reference in its entirety.

FIELD

The subject matter described herein relates generally to embodiments of various furniture apparatuses, and more specifically to furniture apparatuses with integrated storage compartments and associated systems and methods.

BACKGROUND

Humanity has a long history of crafting and using outdoor furniture dating back to ancient Egypt, Rome, China, Mesopotamia, and other civilizations. Humanity has long enjoyed relaxing outdoors, enjoying fresh air, conversing with friends and family, eating meals, and otherwise being out in nature and crafted outdoor furniture to aid in participation in these activities. Numerous different materials have been used to construct outdoor furniture, including wood, metal, reeds, synthetics, stone, and other materials. For added comfort, humans have added many different types of cushions, pillows, blankets, towels, rugs, and other textiles as one or more layers providing comfort between the human body and harder or less forgiving surfaces.

While harder materials used to construct outdoor furniture generally degrade at a slow rate due to the elements, normal and inclement weather can cause rapid deterioration in softer materials, such as textiles. Color bleaching by exposure to the sun is common in textiles left in the sun's rays for long periods of time and repeated exposure. Fiber breakdown can cause rips and tears in textiles where repeated exposure to moisture, wind dirt, sand, mud, salt, minerals, and other naturally occurring substances and elements. Fiber breakdown can also occur due to exposure to food and drinks that are spilled on textiles and repeated use by humans and animals.

As with textiles, small objects are more likely to be damaged when left outdoors without protection. Examples are varied and can include dishes, shoes and sandals, toys, decorations, and numerous others. Objects and textiles prone to more rapid deterioration generally require indoor storage or outdoor storage in special cabinets, chests, and other storage units in order to protect them from natural elements and prolong their life cycles. Storage of items is a concern in nearly every climate and item storage may be costly or better used for other purposes in locations where storage space is at a premium.

Thus, needs exist for improved techniques by which to store articles and items for outdoor activities.

SUMMARY

Provided herein are embodiments of systems, devices, and methods for manufacturing, building, and using outdoor furniture with integrated storage compartments.

In various embodiments disclosed herein, textiles such as cushions, pillows, and blankets and other small items can be stored within outdoor furniture pieces, protecting them from natural elements and keeping them safe, secure, dry, and clean.

Storing items within outdoor furniture pieces provides numerous advantages, including time and space savings for users. As such, users are able to take advantage of the convenient aspects of no longer having to move cushions and other items from one location to another when using or cleaning up an area. This can also remove the need for dedicated pieces of storage furniture, cabinets, boxes and other items that may take up valuable space. Additionally, time savings is increased where users do not need to transport cushions and other items from one location to another when packing up and storing items and also time when unpacking and arranging items for use.

As an example, many resort hotels are in locations that may experience heavy rain, wind, and/or snow that can cause negative effects to items left outdoors. As such, employees of these resort hotels are forced to gather all cushions and other items as quick as possible from outdoor furniture items such as lounge chairs and tables and move them to a safe, dry area. When the inclement weather ceases, the employees are then forced to transport the cushions and other items back to their previous locations, for use by guests. This activity can help to protect the assets of the resort hotels and can provide guests with dry cushions, which are highly preferable to soggy cushion or broken items. As such, time and monetary savings are vastly improved by providing outdoor furniture with integrated storage compartments. For example, there is a reduced risk of an employee falling while walking and carrying items, thus a reduced risk of insurance claims or lawsuits against the resort hotels. Additionally, where employees have to walk to a relatively remote location for storage, employees could finish their storage tasks in a reduced amount of time and with a reduced chance of breaking any items. Further, employees can finish their tasks faster and move on to other, more productive tasks.

The configuration of the devices described herein in detail are only example embodiments and should not be considered limiting. Other systems, devices, methods, features, and advantages of the subject matter described herein will be or will become apparent to one with skill in the art upon examination of the following figures and detailed description. It is intended that all such additional systems, devices, methods, features and advantages be included within this description, be within the scope of the subject matter described herein and be protected by the accompanying claims. In no way should the features of the example embodiments be construed as limiting the appended claims, absent express recitation of those features in the claims.

BRIEF DESCRIPTION OF THE FIGURES

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

DETAILED DESCRIPTION

Before the present subject matter is described in detail, it is to be understood that this disclosure is not limited to the particular embodiments described, as such may, of course, vary. It is also to be understood that the terminology used herein is for the purpose of describing particular embodiments only, and is not intended to be limiting, since the scope of the present disclosure will be limited only by the appended claims.

The following description of the preferred embodiments of the invention is not intended to limit the invention to these preferred embodiments, but rather to enable any person skilled in the art to make and use this invention. Further, the figures herein are not meant to be limiting based on any scale or size relation illustrated but rather are meant to be example embodiments illustrative of concepts. Although any methods, materials, and devices similar or equivalent to those described herein can be used in the practice or testing of embodiments, the preferred methods, materials, and devices are now described.

Provided herein are systems, devices, and methods of manufacturing furniture items with integrated storage compartments. In particular, outdoor furniture items are disclosed, although the disclosure herein is not limited to such and can be extended to indoor and hybrid indoor-outdoor furniture items, as would be understood by one of skill in the art.

Figure 1A:
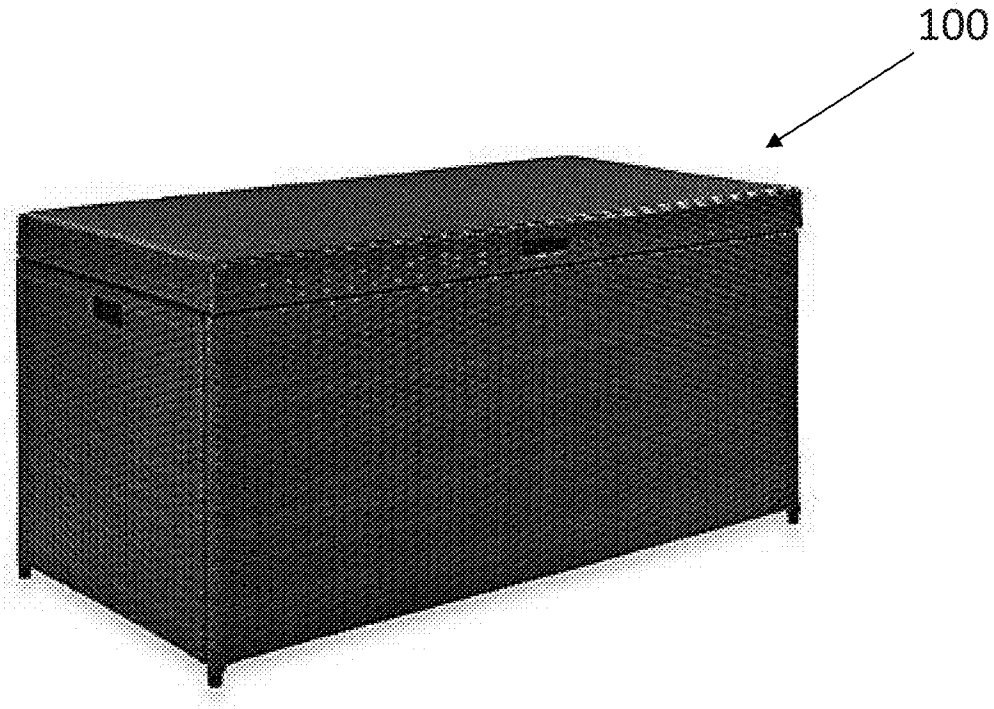
PRIOR ART FIG. 1A
FIGS. 1A-1C show example embodiment perspective views of a prior art dedicated piece of storage furniture in a closed, open, and open with cushions inserted configurations.
Figure 1B:
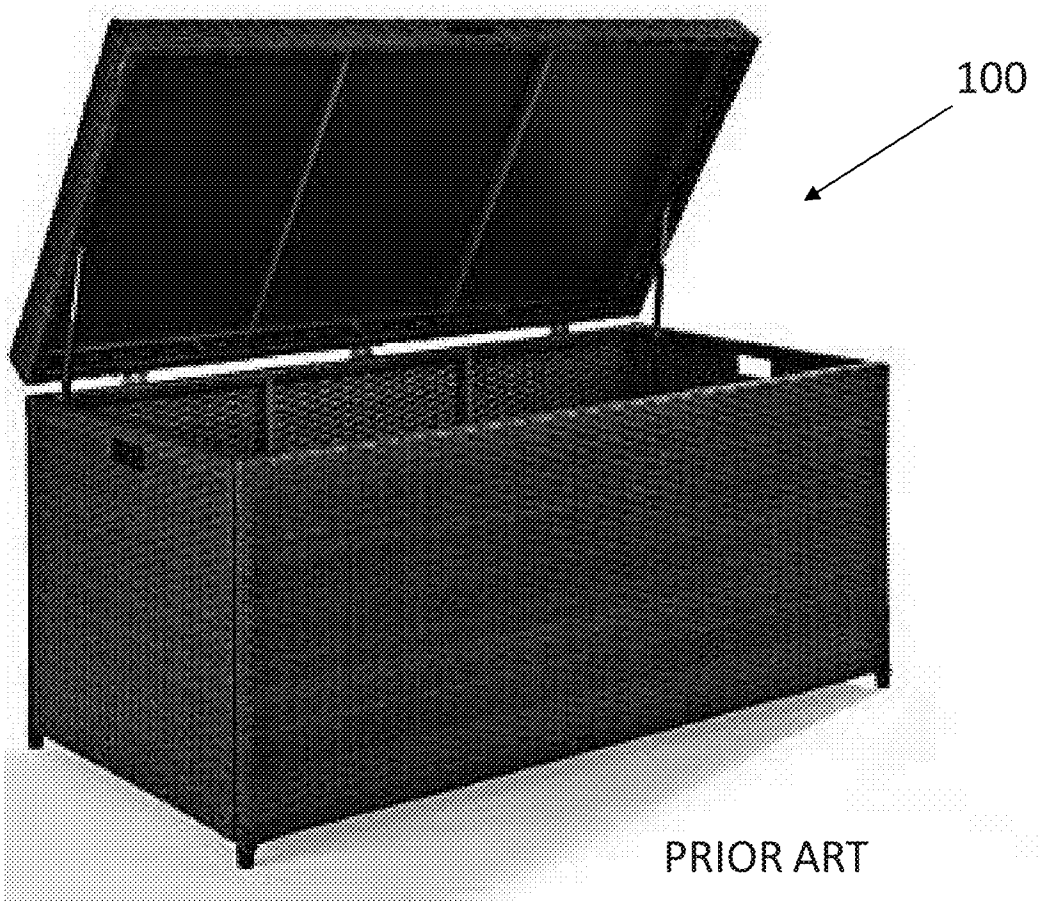
Figure 1C:
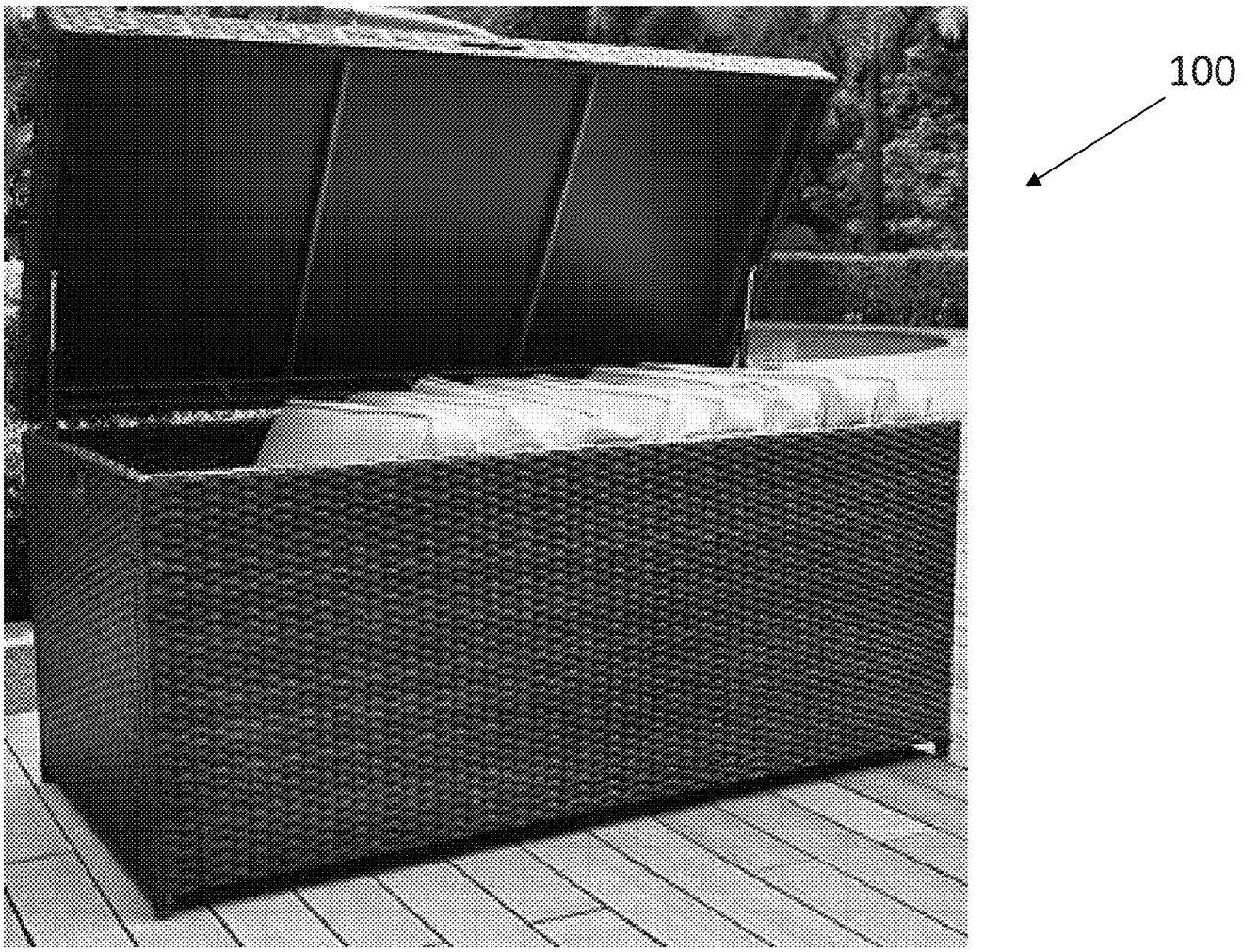
FIG. 1C PRIOR ART

FIGS. 1A-1C show example embodiment perspective views of a prior art 100 dedicated piece of storage furniture in a closed, open, and open with cushions inserted configurations. As shown in the example embodiments, a crate or other dedicated piece of storage furniture may be large enough to store numerous cushions for a variety of different pieces of furniture or other items. In general, these dedicated pieces of storage furniture serve no other purpose than to store cushions and other items. When in use, cushions from other pieces of furniture can be removed from the other furniture and stored in an internal storage compartment within the dedicated piece of storage furniture. However, when not in use, these dedicated pieces of storage furniture take up valuable space. As such, it would be useful to eliminate dedicated pieces of storage furniture while maximizing use of outdoor furniture space.

Examples of outdoor furniture items that can include integrated storage compartments for storing cushions and other items and which are not dedicated pieces of storage furniture can include sitting furniture, such as: sofas, sectionals, side chairs, dining chairs, lounge chairs, high chairs, bar chairs, stools, recliners and others; table furniture, such as: cocktail tables, coffee tables, dining tables, side tables, desks, and others; lying down furniture, such as beds; furniture to rest feet upon, such as ottomans; and various other types of non-dedicated storage furniture.

Although not explicitly shown or described in the example embodiments herein, additional components known for outdoor and indoor furniture can be combinable in various additional embodiments. Examples include arm rests, cup holders, ash trays, movable/adjustable/extendable platters, footrests, side tables, headrests, and other furniture related features.

In general, furniture pieces with integrated storage compartments can include an external, outer shell or base with one or more doors, lids, drawers or other movable components. These movable components can provide access to one or more internal compartments by pivoting about one or more hinges; swiveling about a fixed bolt or securing mechanism; sliding in or out of a secondary compartment; sliding sideways or up and down; or other mechanisms. In an open position, these doors, lids drawers or other movable compartments can reveal and provide access to an internal chamber of one or more interior storage compartments that are operable to house items, such as cushions. In some embodiments, these movable components may provide access to a second layer movable component constructed of the same or different materials in order to provide an additional layer of safety or security for internal compartments.

In some embodiments, whole or parts of panels can be large or sized the same as entire sections or walls of furniture pieces. As an example, a chair back that a chair user may rest against when seated that has an internal storage compartment may pivot forward about a hinge in an upward, downward, left or right revealing an internal chamber that can be used as a storage space for storing a chair cushion.

In some embodiments, the internal chamber or chambers of the storage compartments can be made of natural materials such as stone, wood, plant fibers and others. In some embodiments, they can be made of synthetic materials including plastics, various polymers, and others.

Internal chambers can be hermetically sealed in some embodiments, such that they are airtight, waterproof, water resistant, or otherwise partially, substantially or wholly sealed from external elements.

In various embodiments, cushions can include clean, minimalist lines without dangling items such as ties, without hook and loop fastener patches or other securing items. In some embodiments, cushions can be included or otherwise integrated with furniture having internal storage spaces. In some of these embodiments, cushions can have one or more internal or external magnets 722 on or in fabric on one or more surfaces that magnetically couples with one or more magnets 724 of the piece of furniture with integrated storage. This can allow the cushion to maintain a relatively fixed position with respect to the furniture item, while providing advantages in the form of time savings, since removal and placement are facilitated by the magnetic coupling with relative ease, Magnets 722,724 can be permanent state magnets or electromagnets with on and off switches, power sources such as batteries or cord plugins, and other necessary associated components, as should be understood by those in the art.

In some embodiments, internal compartments should be sized such that they fully house a cushion for one or more furniture items within an internal chamber.

FIGS. 2A-2D show an example embodiment of a square cocktail table 200A, 200B, 200C, 200D with integrated storage from top and side cross-sectional views.

Figure 2A:
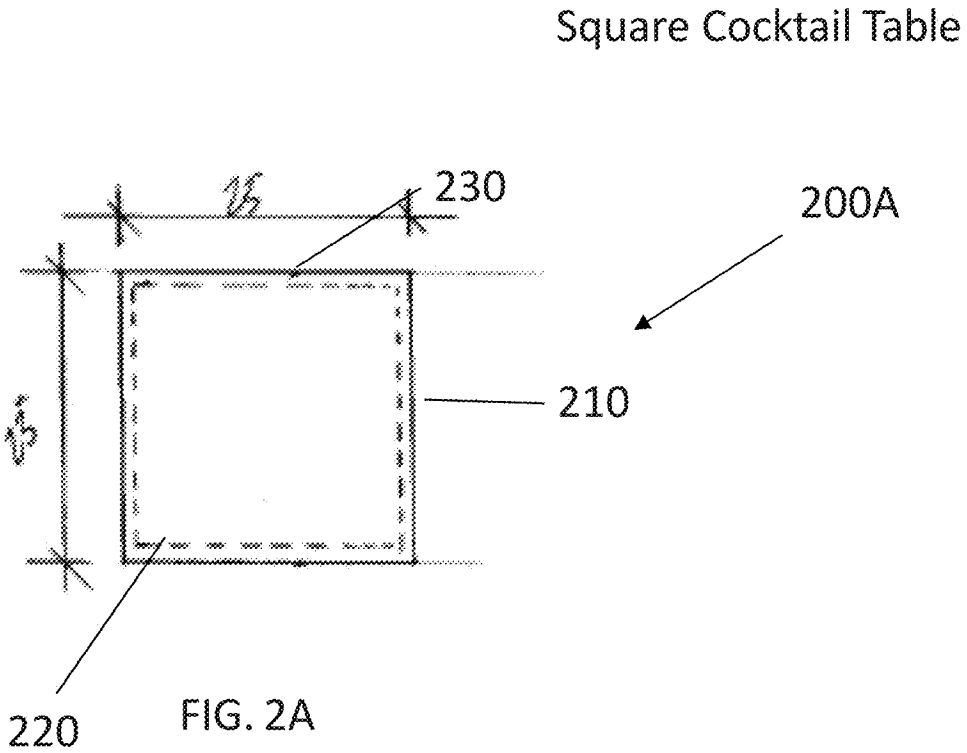
FIGS. 2A-2C show an example embodiment of a square cocktail table with integrated storage from top and side cross-sectional views.

As shown in FIG. 2A, an upper surface 230 of the square cocktail table 200A with side surface 210 can be relatively or completely flat and an internal compartment, indicated by the dashed lines in the figure, may be sized such that it matches a substantial portion of the surface area of the upper surface 230. Square cocktail tables can be various dimensions in different embodiments. In some embodiments, dimensions of an upper surface 230 can be about 23 inches wide by 23 inches long.

Figure 2C:
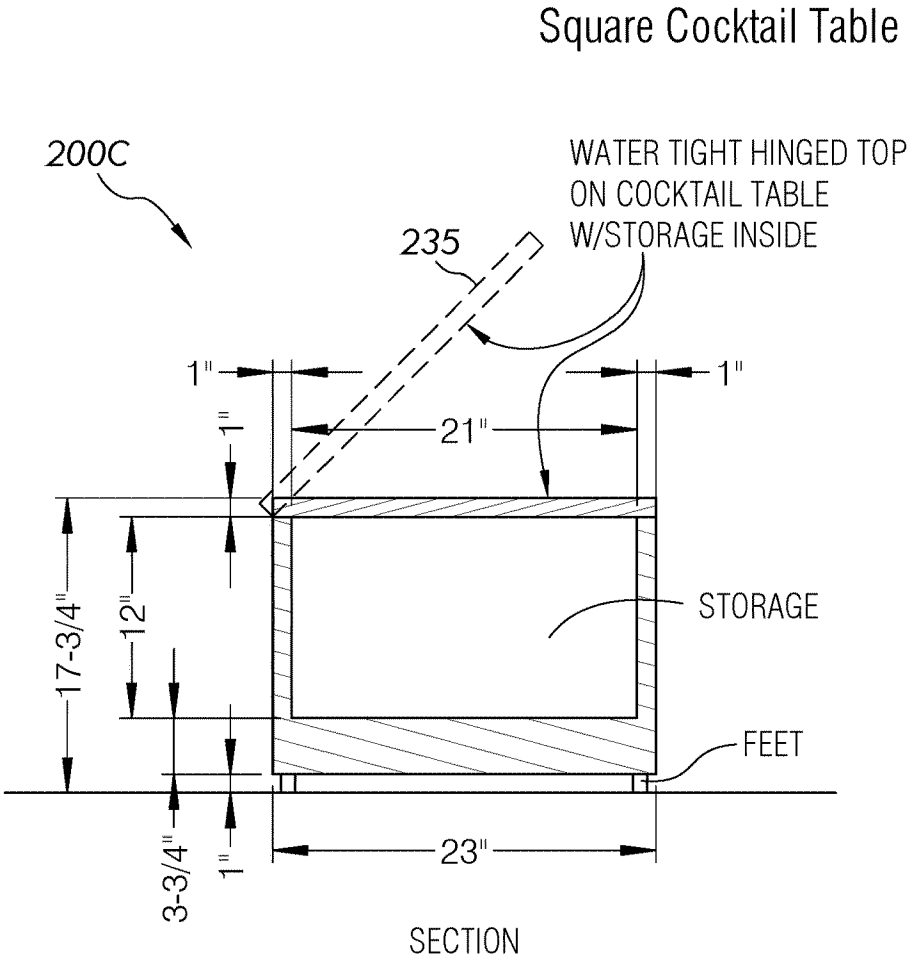
Figure 2B:
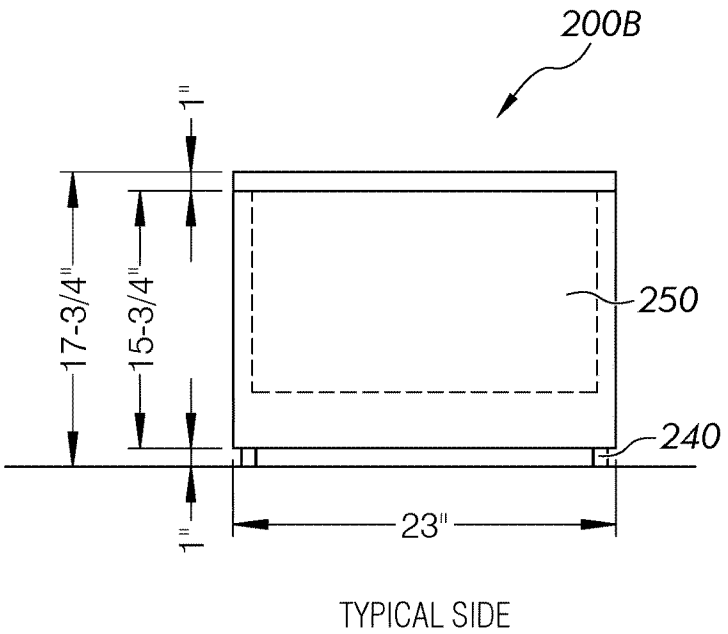

As shown in FIG. 2B, a side cross-sectional view of a square cocktail table 200B can have a box shape, which may extend down to one or more supporting feet or legs. In the example embodiment, the square cocktail table has exterior dimensions of about 15¾ inches from a lower edge above the legs or feet to an upper edge that is positioned below a sealable lid. A distance from a bottom edge of the legs or feet 240 in contact with a floor, deck, ground, or other supporting surface to an upper surface of a lid can be about 17¾ inches. As such, the lid 235 may have a maximum thickness of slightly less than two inches from an upper surface edge to a surface edge that is flush with an upper surface edge of a wall of the square cocktail table.

As shown in FIG. 2C, the square cocktail table 200C has an interior chamber 250 with dimensions of about 12 inches from a supporting internal surface edge with an internal clearance of about 3¾ inches above an upper internal bottom surface edge of the base of the square cocktail table. A distance from one or multiple exterior walls 220 of the storage compartment to an internal wall of the base or exterior shell of the square cocktail table can be about one inch. As shown in the example embodiment, the distance from one internal wall to an opposing internal wall of the internal compartment can be about 21 inches. As shown in the example embodiment, the square cocktail table 200C can have one side coupled with one or more hinges that are also coupled to the lid and allow the lid to be rotated about the hinges. In some embodiments, hinges can be internally positioned, externally positioned, or combinations of both. The base or exterior shell can be coupled with the internal storage compartment 250 in some embodiments, while in other embodiments the internal storage compartment may rest within a complementary or differently sized space within the external shell. These couplings can be adhesive, mechanical, or others in various embodiments. In many embodiments, the lid 235 can provide a watertight seal for the internal storage compartments and as such, may have one or more internal lips, protrusions or other features.

Figure 2E:
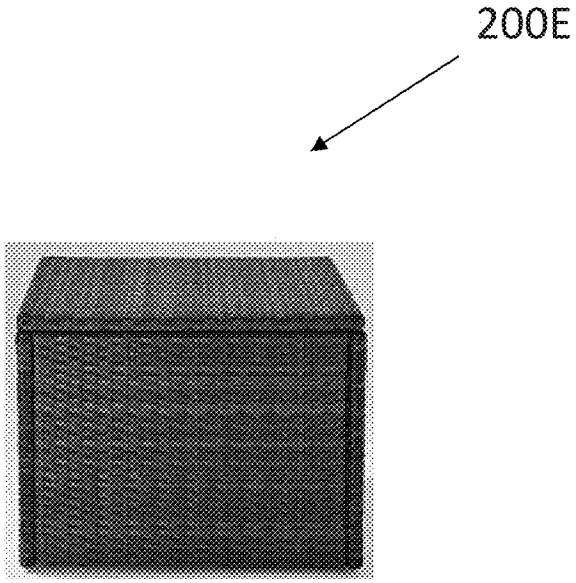
FIGS. 2D and 2E show example embodiments of a square cocktail table with integrated storage from front and side angled side perspective views.
Figure 2D:
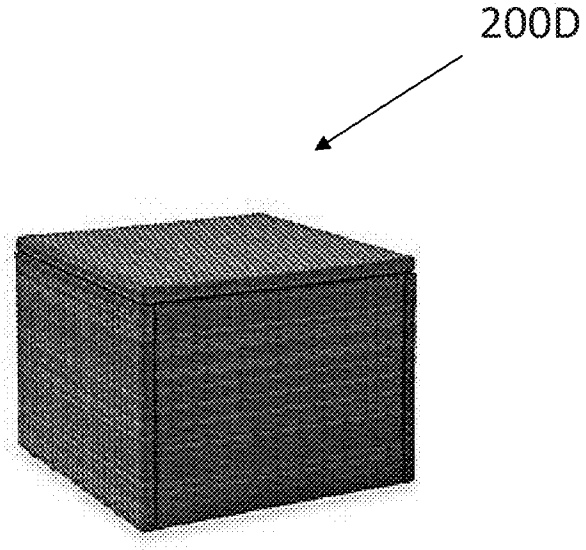

FIGS. 2D and 2E shows an example embodiment of a closed and sealed square cocktail table 200D with integrated storage from front and side angled side perspective views. In some embodiments, an external shell of the square cocktail table can be a durable powder-coated steel that is covered and coupled with an all-weather resin wicker. This can provide a durable cocktail table that is weather resistant and can operable to survive many seasons, while protecting items stored in the internal storage compartment. In some embodiments, square cocktail tables can be preassembled, while in others, users may assemble one or more components themselves.

FIGS. 3A-3D show an example embodiment of a rectangular cocktail table 300A, 300B, 300C, 300D with integrated storage from top and side cross-sectional views.

Figure 3A:
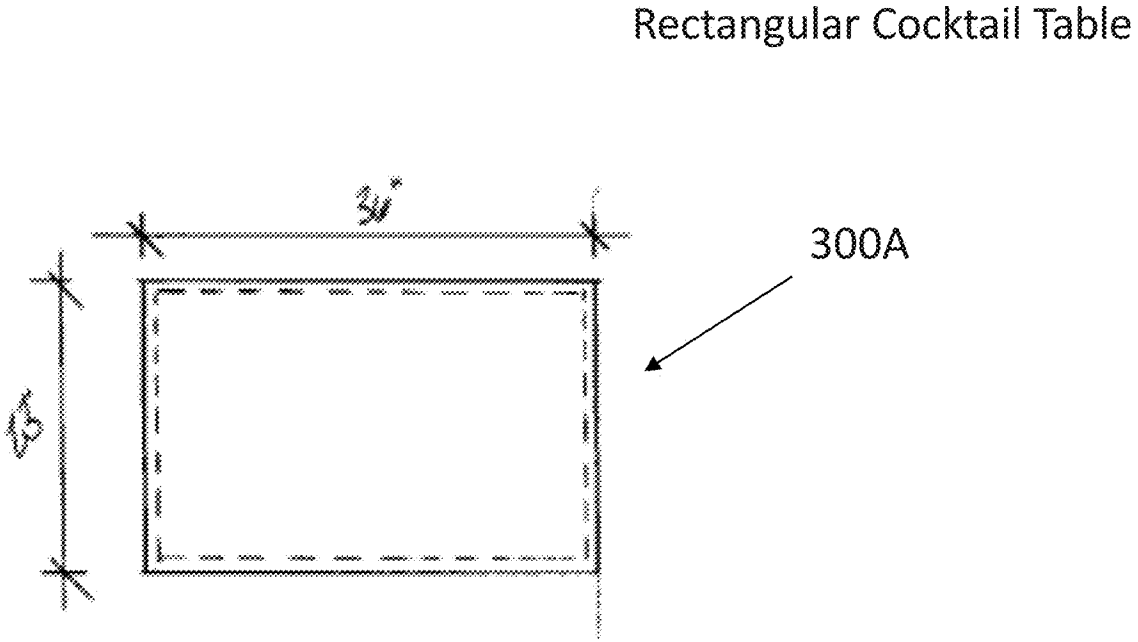
FIGS. 3A-3D show an example embodiment of a rectangular cocktail table with integrated storage from top and side cross-sectional views.
Figure 3B:
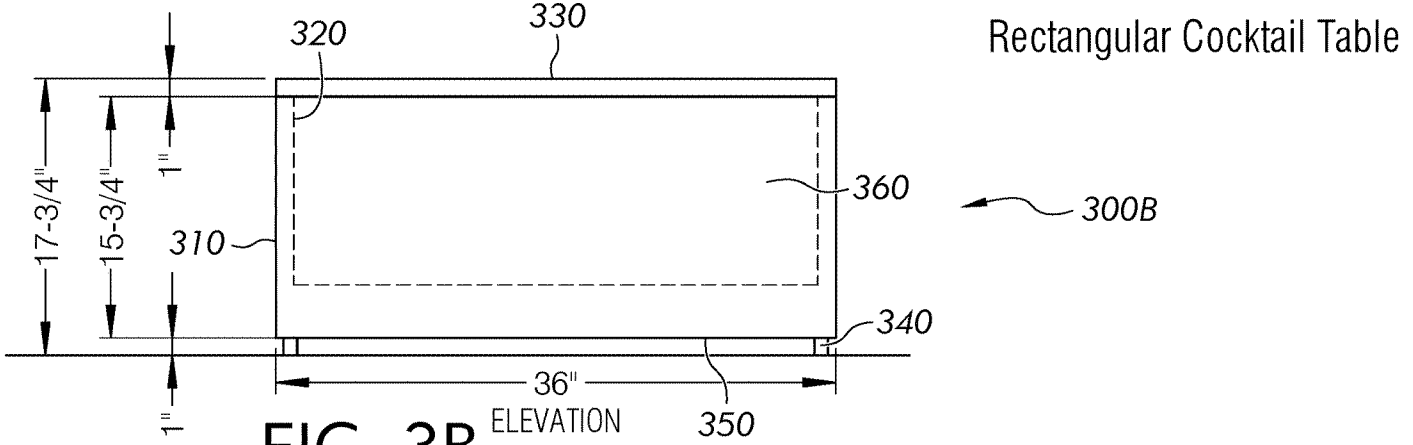

As shown in FIGS. 3A and 3B, an upper surface 330 of the rectangular cocktail table with side surfaces 310 can be relatively or completely flat and an internal compartment 360, indicated by the dashed lines 320 in the figure, may be sized such that it matches a substantial portion of the surface area of the upper surface 330. Rectangular cocktail tables can be various dimensions in different embodiments. In some embodiments, dimensions of an upper surface can be about 23 inches wide by about 36 inches long.

As shown in FIG. 3B, a side cross-sectional view of a rectangular cocktail table 300B can have a box shape, which may extend down to one or more supporting feet or legs 340 on the lower surface 350. In the example embodiment, the rectangular cocktail table has exterior dimensions of about 153/4 inches from a lower edge above the legs or feet to an upper edge that is positioned below a sealable lid. A distance from a bottom edge of the legs or feet 340 in contact with a floor, deck, ground, or other supporting surface to an upper surface of a lid 335 can be about 17¾ inches. As such, the lid 335 may have a maximum thickness of slightly less than two inches from an upper surface edge to a surface edge that is flush with an upper surface edge of a wall of the rectangular cocktail table.

Figure 3D:
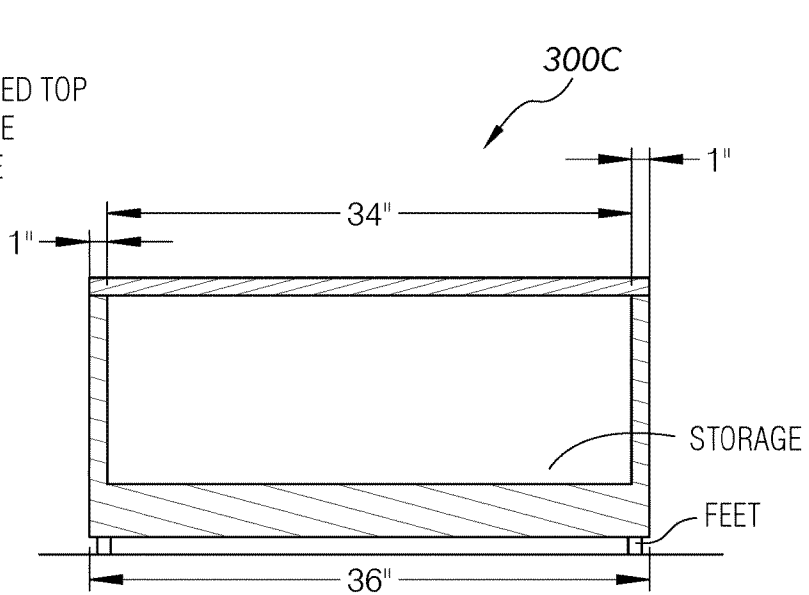
Figure 3C:
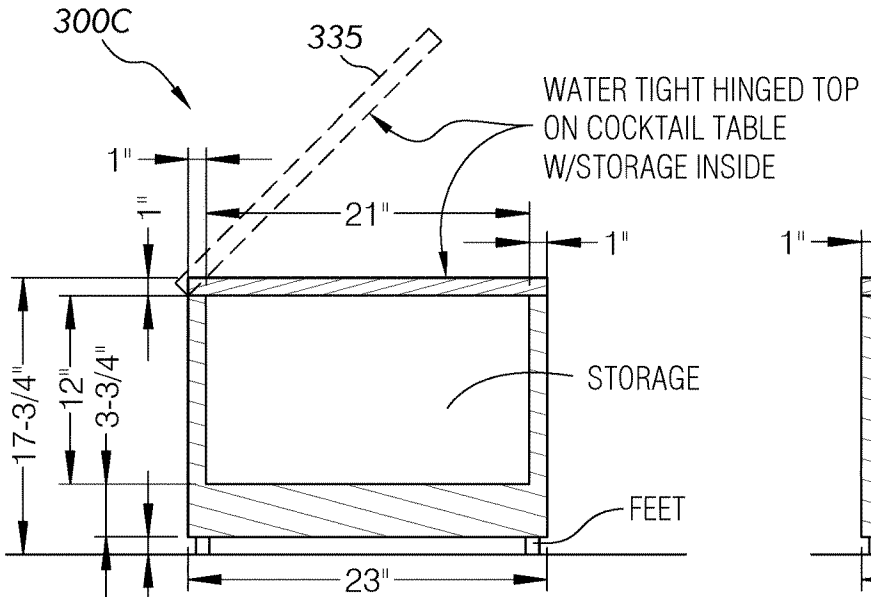

As shown in FIGS. 3C and 3D, the rectangular cocktail table 300C has an interior chamber with dimensions of about 12 inches from a supporting internal surface edge with an internal clearance of about 3¾ inches above an upper internal bottom surface edge of the base of the rectangular cocktail table. A distance from one or multiple exterior walls 320 of the storage compartment to an internal wall of the base or exterior shell of the rectangular cocktail table can be about one inch. As shown in the example embodiment, the widthwise distance from one internal wall to an opposing internal wall of the internal compartment can be about 21 inches, while the lengthwise distance from one internal wall to an opposing internal wall of the internal compartment can be about 34 inches. As shown in the example embodiment, the rectangular cocktail 300C table can have one lengthwise side coupled with one or more hinges that are also coupled to the lid and allow the lid to be rotated about the hinges. In some embodiments, hinges can be internally positioned, externally positioned, or combinations of both. The base or exterior shell can be coupled with the internal storage compartment 360 in some embodiments, while in other embodiments the internal storage compartment 360 may rest within a complementary or differently sized space within the external shell. These couplings can be adhesive, mechanical, or others in various embodiments. In many embodiments, the lid can provide a watertight seal for the internal storage compartments and as such, may have one or more internal lips, protrusions or other features.

In some embodiments, an external shell of the rectangular cocktail table can be a durable powder-coated steel that is covered and coupled with an all-weather resin wicker. This can provide a durable cocktail table that is weather resistant and can operable to survive many seasons, while protecting items stored in the internal storage compartment. In some embodiments, rectangular cocktail tables can be preassembled, while in others, users may assemble one or more components themselves.

FIGS. 4A-4D show an example embodiment of a dining chair 400A, 400B, 400C, 400D with integrated storage from top and side cross-sectional views.

Figure 4B:
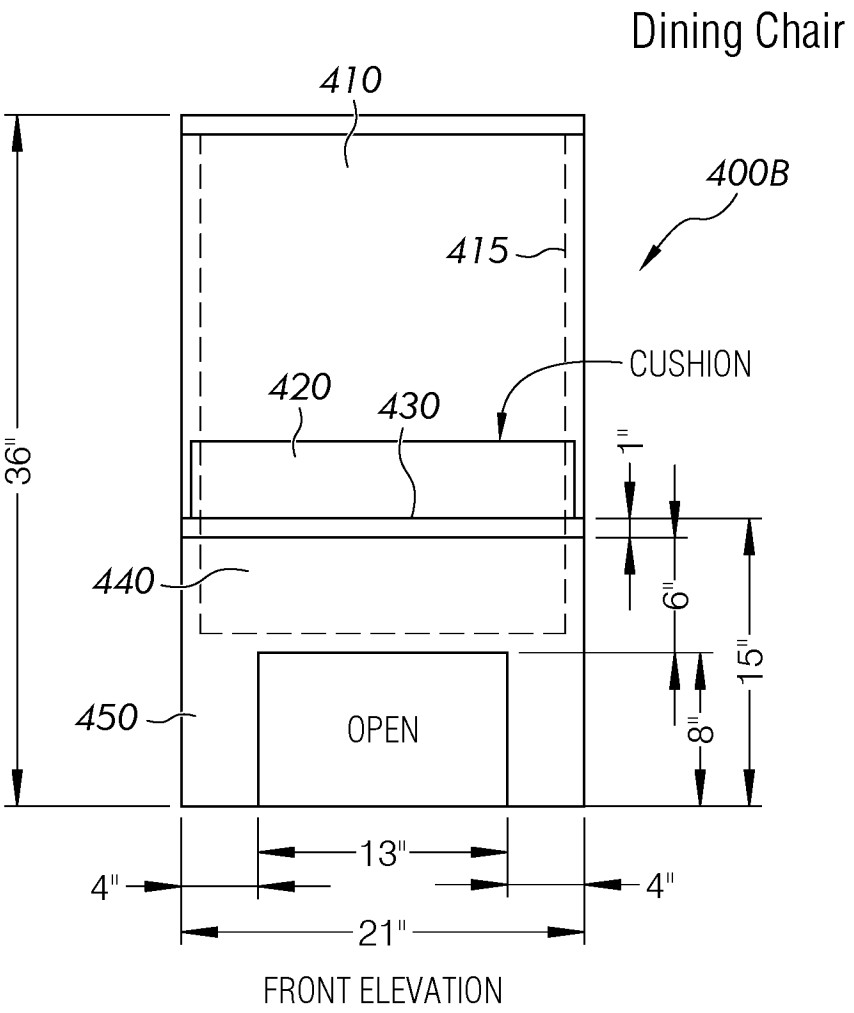
FIGS. 4A-4D show an example embodiment of a dining chair with integrated storage from top and side cross-sectional views.
Figure 4A:
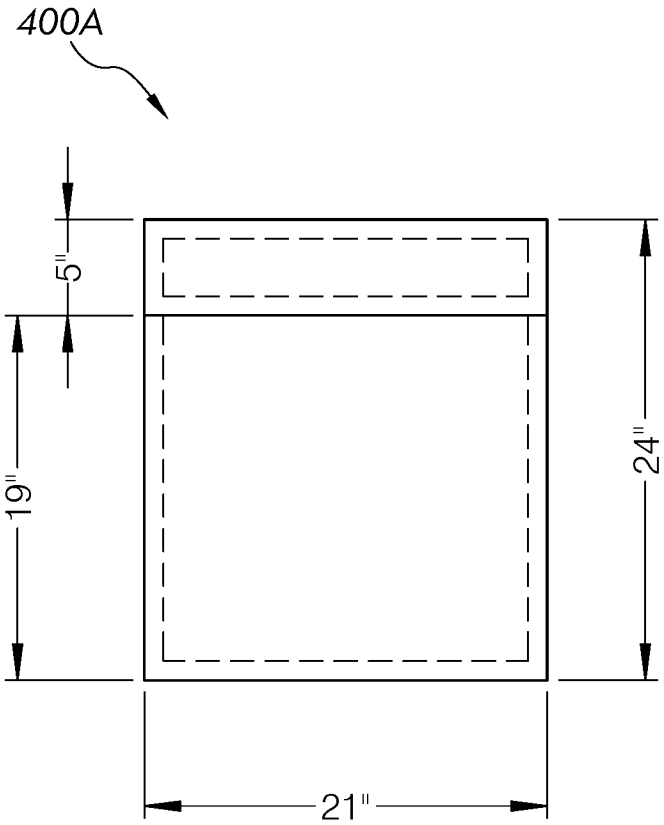

As shown in FIG. 4A, an upper surface of the back of the dining chair with seating portion 420 and back portion 410 can be relatively or completely flat and include a first internal compartment 415, indicated by the dashed lines in the figure, may be sized such that it matches a substantial portion of the surface area of the upper surface. In some embodiments, dimensions of an upper surface of the back 410 of the dining chair can be about 5 inches wide by about 21 inches long. As shown, an upper seating surface 430 can be about 19 inches long and about 21 inches wide and include a second internal compartment. The second internal compartment 440 may be sized such that it matches a substantial portion of the surface area of the upper seating surface 430. A combined length of the upper seating surface 430 and upper back surface can be about 24 inches. Dining chairs can be various dimensions in different embodiments.

As shown in FIG. 4B, a front cross-sectional view of the dining chair can have a general chair shape, with one or more supporting feet or legs 450, a seating surface, and a back. In the example embodiment, the dining chair has total dimensions of about 36 inches from a bottom edge of the legs that is in contact with a floor, deck, ground, or other supporting surface to an upper surface of a back lid. Legs can provide clearance above the ground with an open space in between, as in the example embodiment there are four legs provided. Legs can be about 4 inches wide each and about 8 inches tall from a floor contacting surface to a bottom surface of the body of the chair located below the seating surface. The body of the chair may be about 6 inches thick from a lower suspended surface to a chair body lid. A distance from the bottom edge of the chair legs to the upper seating surface of the body lid can be about 15 inches, providing a lid thickness of about one inch. Legs can be spaced apart such that they are about 13 inches from an inner leg surface to an opposing inner leg surface on a left and right side of the chair when viewed from the front. As such, a total width of the chair from a left facing and right facing surface can be about 21 inches.

Figure 4D:
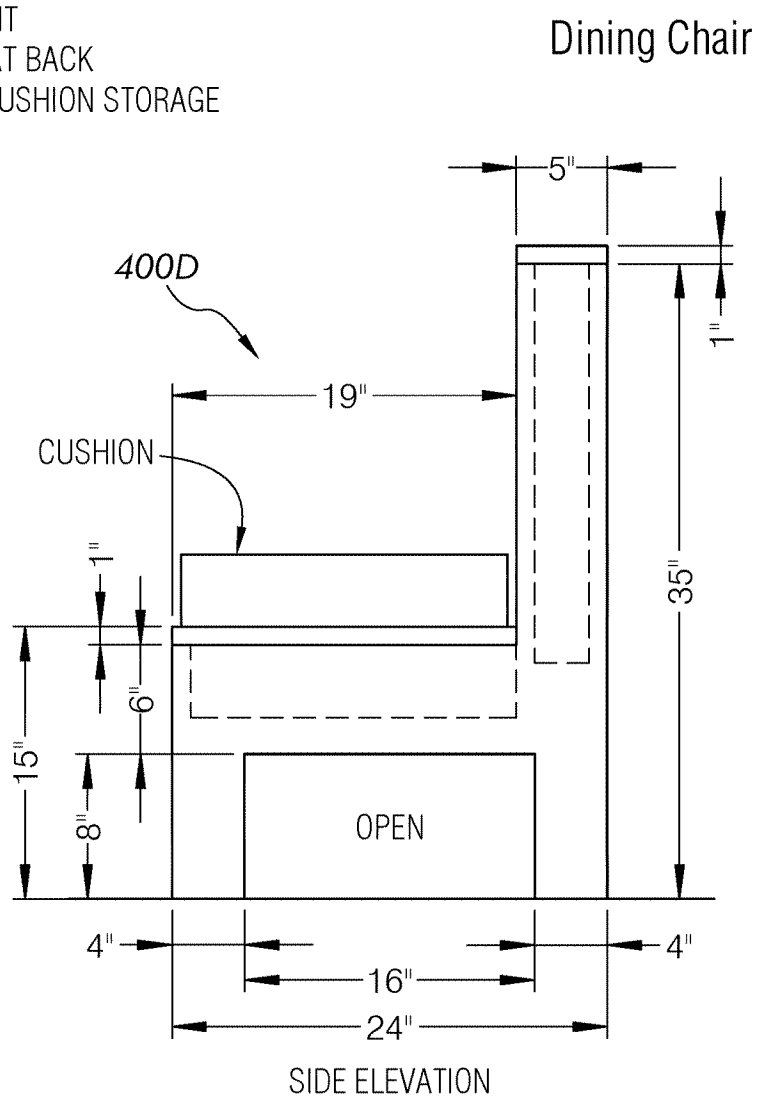
Figure 4C:
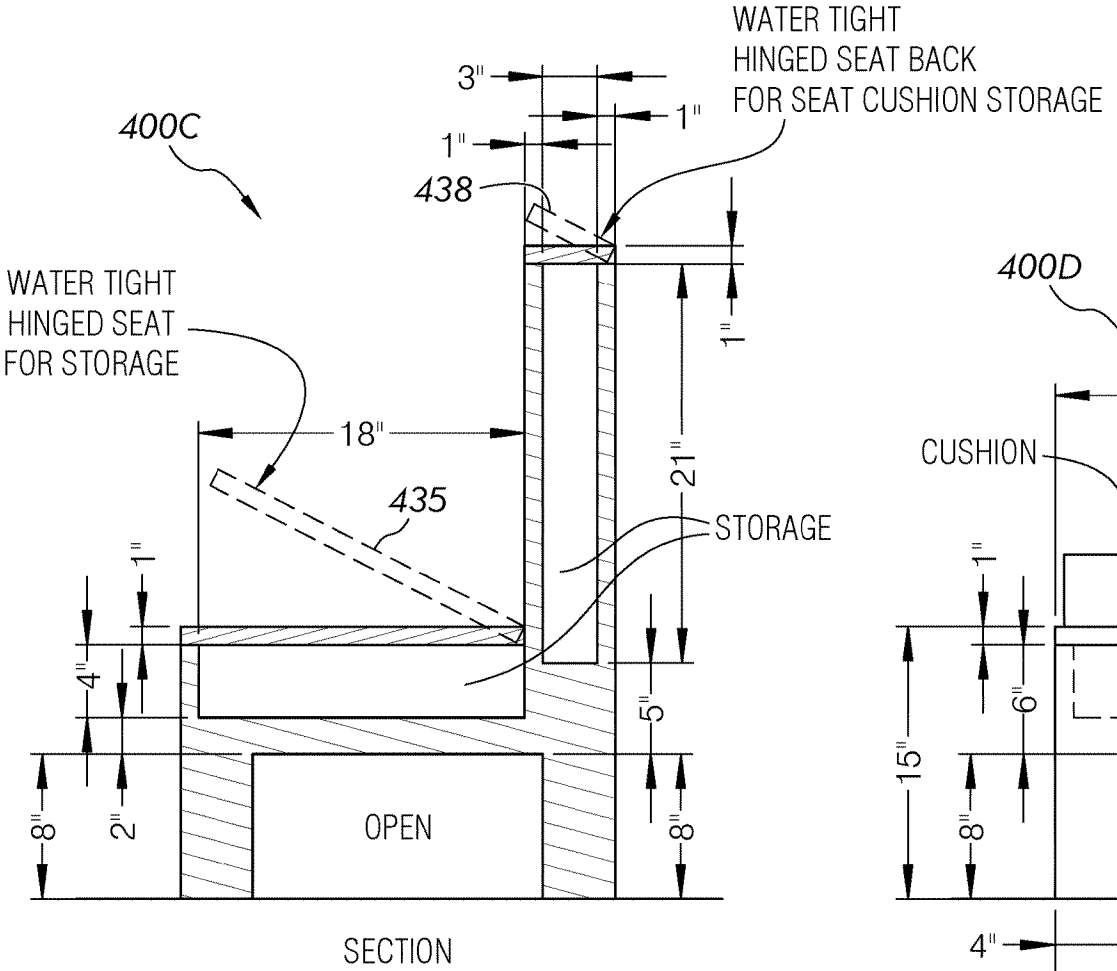

As shown in FIGS. 4C and 4D, the dining chair has a first interior back chamber with dimensions of about 3 inches wide and about 22 inches tall from a supporting internal surface edge about 13 inches above a lower surface of the back legs to a bottom surface of an upper back lid 435. The dining chair has a second interior chair base chamber with dimensions of about 4 inches deep and about 18 inches long from an internal surface edge aligned with the front surface of the chair back. A distance from one or multiple internal facing walls of each storage compartment to a closest external wall of the dining chair or exterior shell of the dining chair can be about one inch. Legs can be about 16 inches apart from front to back and the front facing surface of the dining chair can be about 24 inches from the backward facing surface of the back of the chair. The back of the chair can be about 35 inches from the ground facing surface of the legs to the upward facing surface below the upper lid 438 on the back of the chair. The base of the chair below the upward facing seating surface can be about 6 inches above the downward facing surface of the chair above the legs.

Each lid is about one inch thick. As shown in the example embodiment, the dining chair internal compart lids are coupled along their widthwise back side edges with one or more hinges that are also coupled to the chair body and allow the lids to be rotated about the hinges. In some embodiments, hinges can be internally positioned, externally positioned, or combinations of both. The dining chair base or exterior shell can be coupled with the internal storage compartment in some embodiments, while in other embodiments the internal storage compartment may rest within a complementary or differently sized space within the external shell. These couplings can be adhesive, mechanical, or others in various embodiments. In many embodiments, the lids can provide a watertight seal for the internal storage compartments and as such, may have one or more internal lips, protrusions or other features.

In some embodiments, an external shell of the dining chair can be a durable powder-coated steel that is covered and coupled with an all-weather resin wicker. This can provide a durable dining chair that is weather resistant and can operable to survive many seasons, while protecting items stored in the internal storage compartments. In some embodiments, dining chairs can be preassembled, while in others, users may assemble one or more components themselves.

FIGS. 5A-5D show an example embodiment of an armless chair 500A, 500B, 500C, 500D with integrated storage from top and side cross-sectional views.

Figure 5B:
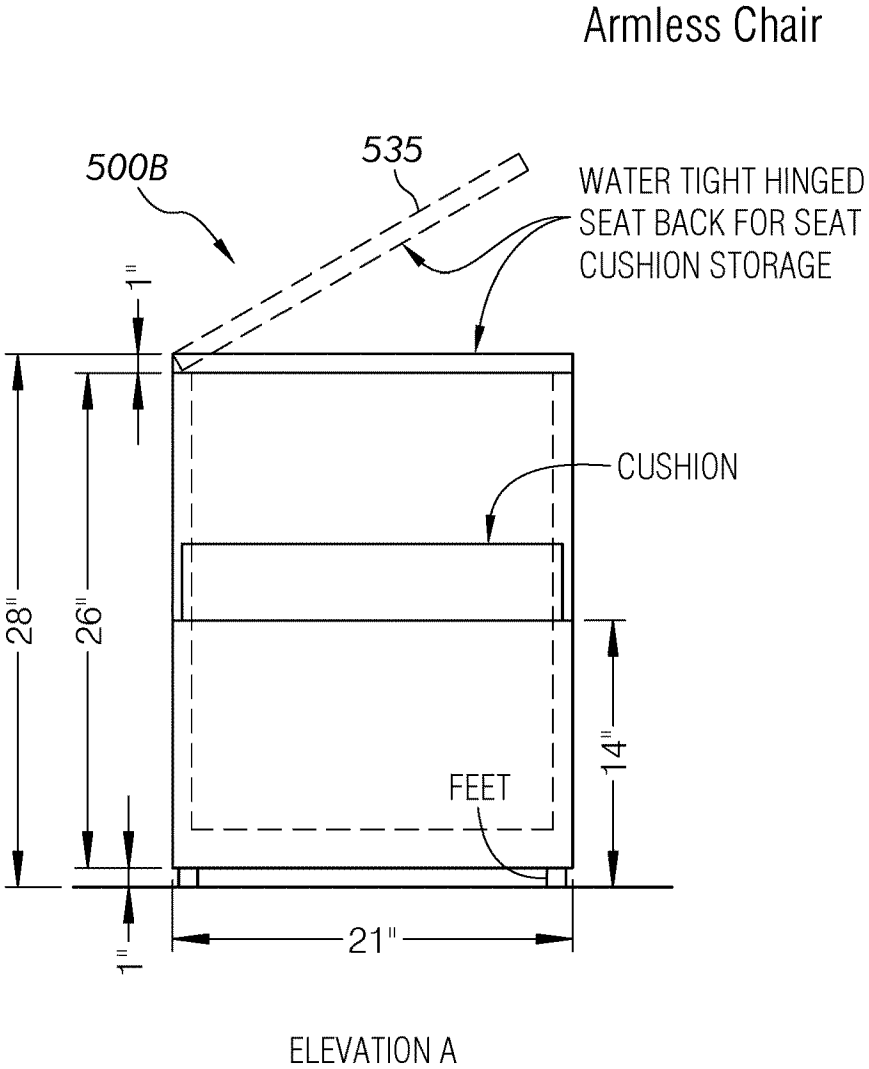
FIGS. 5A-5D show an example embodiment of an armless chair with integrated storage from top and side cross-sectional views.
Figure 5A:
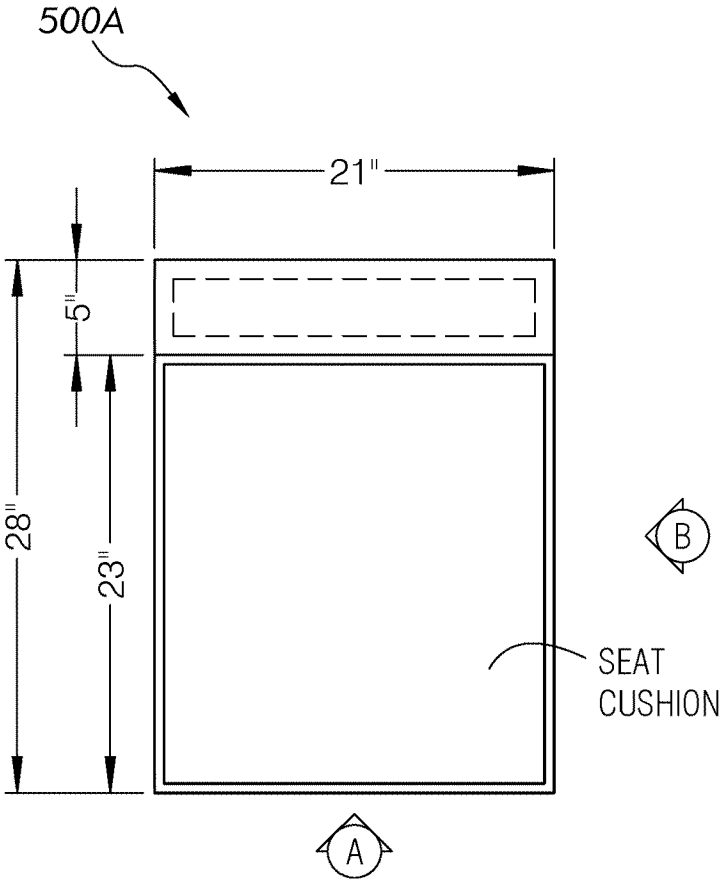

As shown in FIG. 5A, an upper surface 512 of the back 510 of the armless chair 500A can be relatively or completely flat and include a first internal compartment 520, indicated by the dashed lines in the figure, may be sized such that it matches a substantial portion of the surface area of the upper surface. In some embodiments, dimensions of an upper surface 512 of the back of the armless chair can be about 5 inches wide by about 21 inches long. As shown, an upper seating surface 550 can be about 23 inches long and about 21 inches wide. A combined length of the upper seating surface 550 and upper back surface 510 can be about 28 inches. Armless chairs can be various dimensions in different embodiments.

Figure 5D:
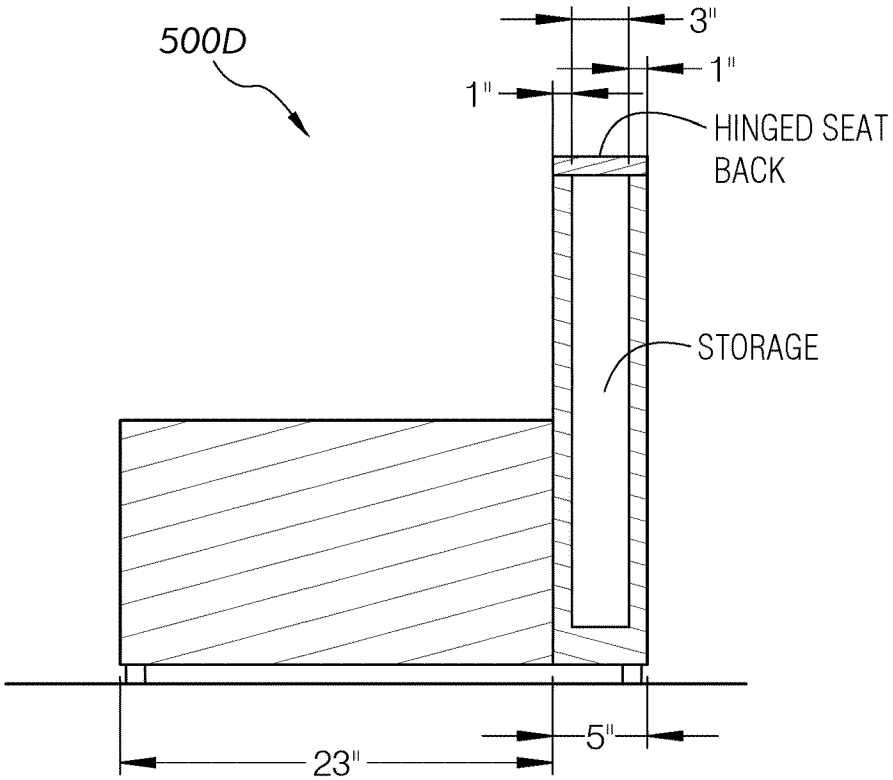
Figure 5C:
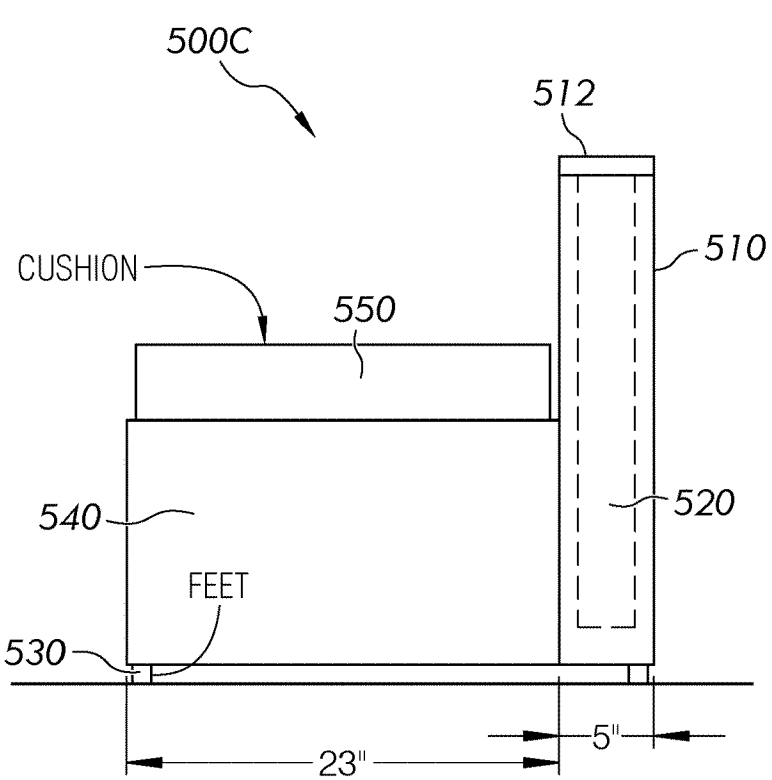

As shown in FIGS. 5B and 5C, a front cross-sectional view of the armless chair can have a general chair shape, with one or more supporting feet or legs 530, a seating surface 550, and a back 510. In the example embodiment, the armless chair has total dimensions of about 28 inches from a bottom edge of the legs that are in contact with a floor, deck, ground, or other supporting surface to an upper surface of a back lid. Legs can provide clearance above the ground with an open space in between, as in the example embodiment there are four legs provided. The body of the chair may be about 14 inches thick from an upper seating surface to the bottom of the legs or feet. A distance from the bottom edge of the chair body above the legs to the upward facing surface of the back of the chair can be about 26 inches, providing a lid thickness of about one inch. A front facing surface of the base of the chair can be about 23 inches from the front facing surface of the back of the chair. The back of the chair can be about 5 inches wide when viewed from the side.

The lid 535 can be about one inch thick. As shown in the example embodiment, the armless chair internal compart lids can be coupled along a side edge of the upper surface of the back of the armless chair with one or more hinges that are also coupled to the chair body and allow the lids to be rotated about the hinges. In some embodiments, hinges can be internally positioned, externally positioned, or combinations of both. The external chair back or exterior shell can be coupled with the internal storage compartment in some embodiments, while in other embodiments the internal storage compartment may rest within a complementary or differently sized space within the external shell. These couplings can be adhesive, mechanical, or others in various embodiments. In many embodiments, the lids can provide a watertight seal for the internal storage compartments and as such, may have one or more internal lips, protrusions or other features.

As shown in FIG. 5D, the dining chair has an interior back chamber with dimensions of about 3 inches wide. A distance from one or multiple internal facing walls of each storage compartment to a closest external wall of the dining chair or exterior shell of the dining chair can be about one inch.

Figure 5E:
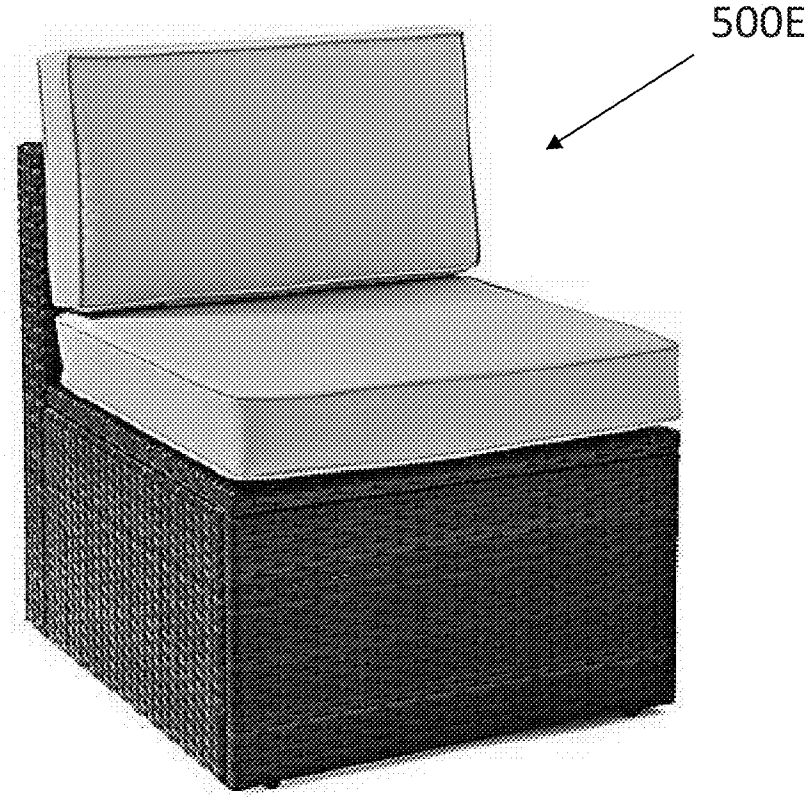
FIG. 5E shows an example embodiment of an armless chair with integrated storage from a side angled side perspective view.

FIG. 5E shows an example embodiment of an armless chair with integrated storage from a side angled side perspective view. In some embodiments, additional chambers can be provided, similar to those shown and described with respect to the dining chair embodiments.

In some embodiments, an external shell of the armless chair can be a durable powder-coated steel that is covered and coupled with an all-weather resin wicker. This can provide a durable armless chair that is weather resistant and can operable to survive many seasons, while protecting items stored in the internal storage compartments. In some embodiments, armless chairs can be preassembled, while in others, users may assemble one or more components themselves. Cushions can be covered with one or more of various textiles, including polyester, which may be spot cleaned, as appropriate.

FIGS. 6A-6D show an example embodiment of a corner-style chair with integrated storage from top and side cross-sectional views.

Figure 6B:
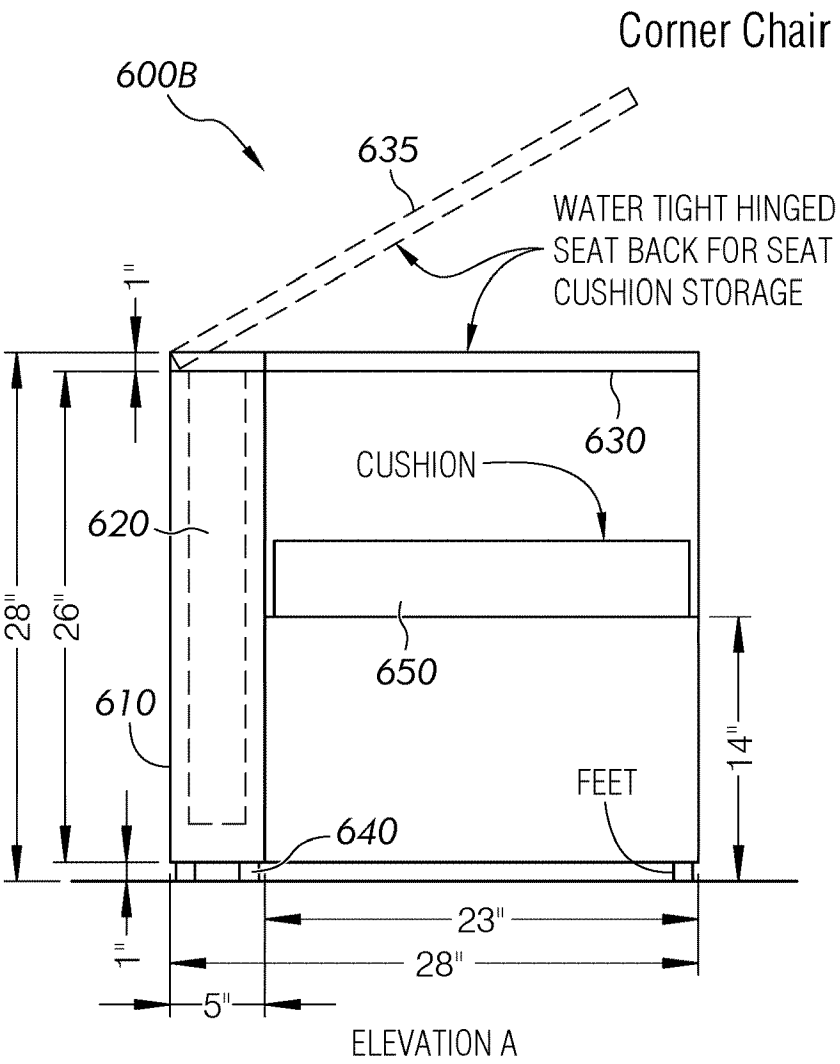
FIGS. 6A-6D show an example embodiment of a corner-style chair with integrated storage from top and side cross-sectional views.
Figure 6A:
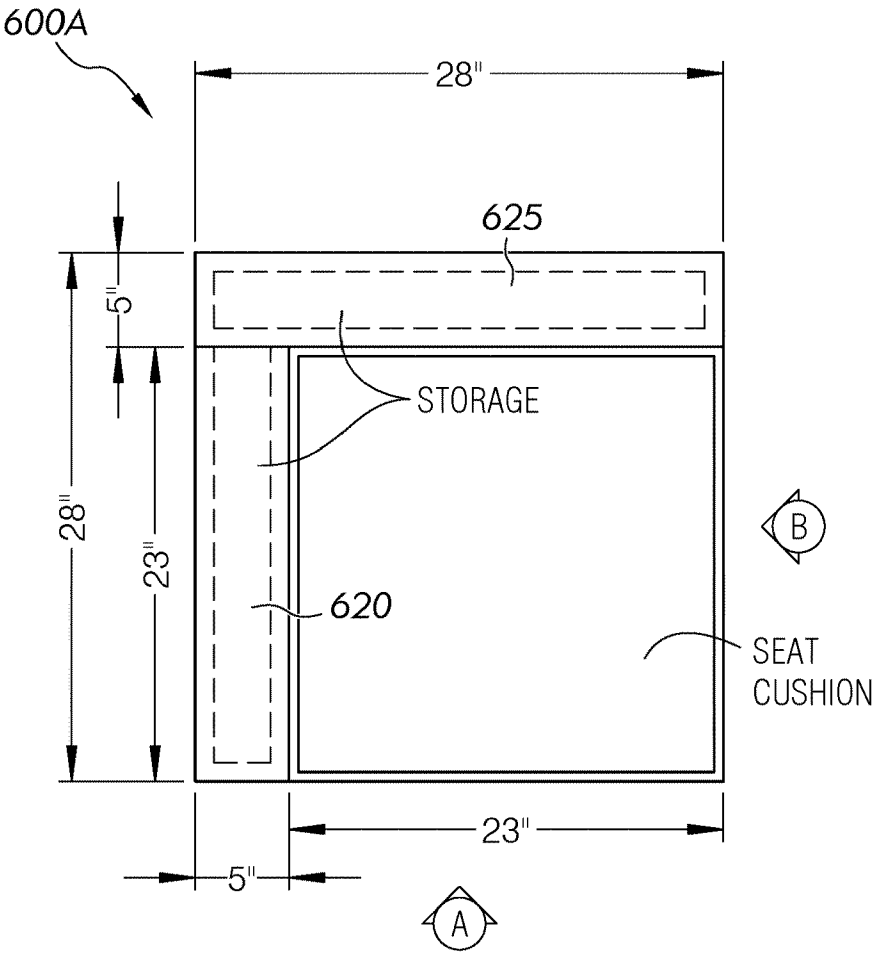

As shown in FIG. 6A, a corner chair can have two backs or a side and a back, depending on classification of the backs and sides. As described herein, the terms are interchangeable with respect to the embodiments shown since they have similar dimensions. As shown, an upper surface 630 of the backs of the corner chair can be relatively or completely flat and include a first internal 620 compartment in one back and a second internal compartment 625 in the other back, as indicated by the dashed lines in the figure. These internal compartments may be sized such that they match a substantial portion of the surface area of the upper surface of each back. In some embodiments, dimensions of an upper surface of the first back of the corner chair can be about 5 inches wide by about 28 inches long. An upper surface of the second back of the corner chair can be about 23 inches long by about 5 inches wide. The backs can be oriented such that they are coupled or otherwise flush with each other and touching in a corner of the corner chair. As shown, an upper seating surface can be about 19 inches long and about 23 inches wide by 23 inches long. A combined length of the upper seating surface and upper back surface can be about 28 inches long by 28 inches wide. Corner chairs can be various dimensions in different embodiments.

Figure 6D:
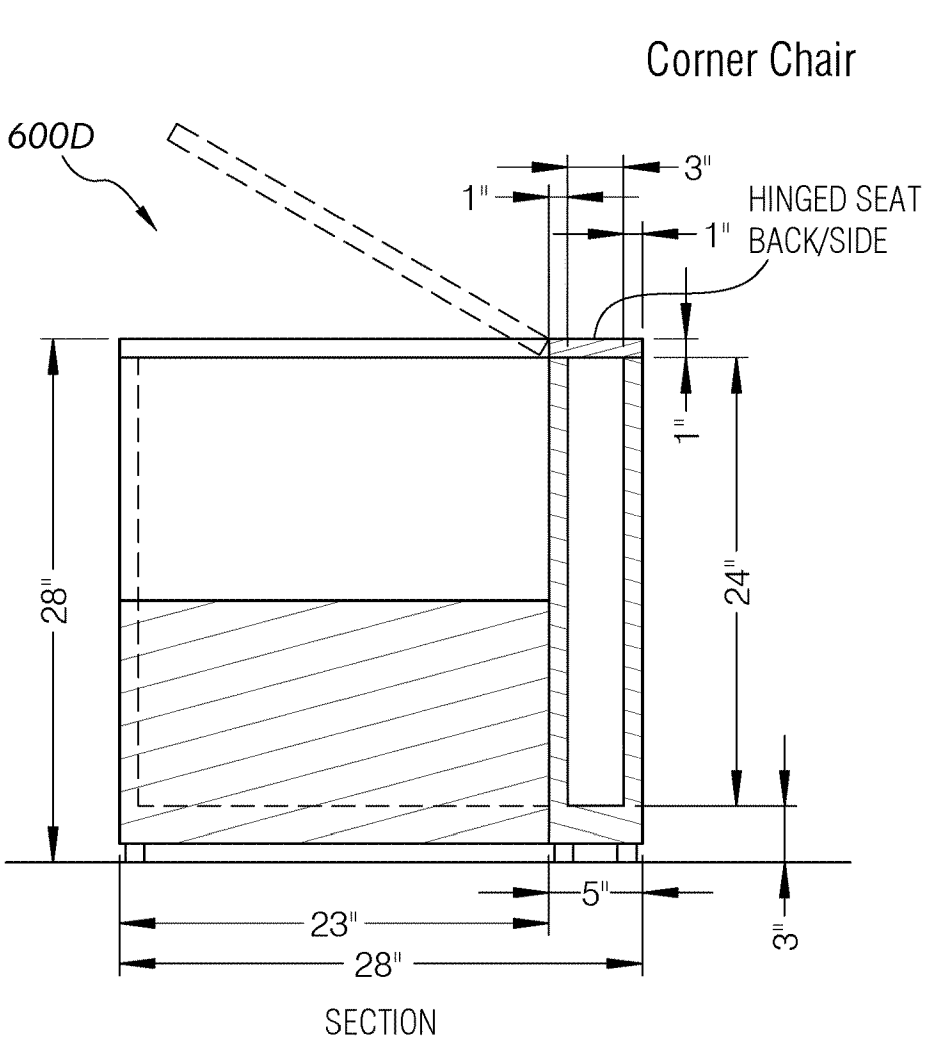
Figure 6C:
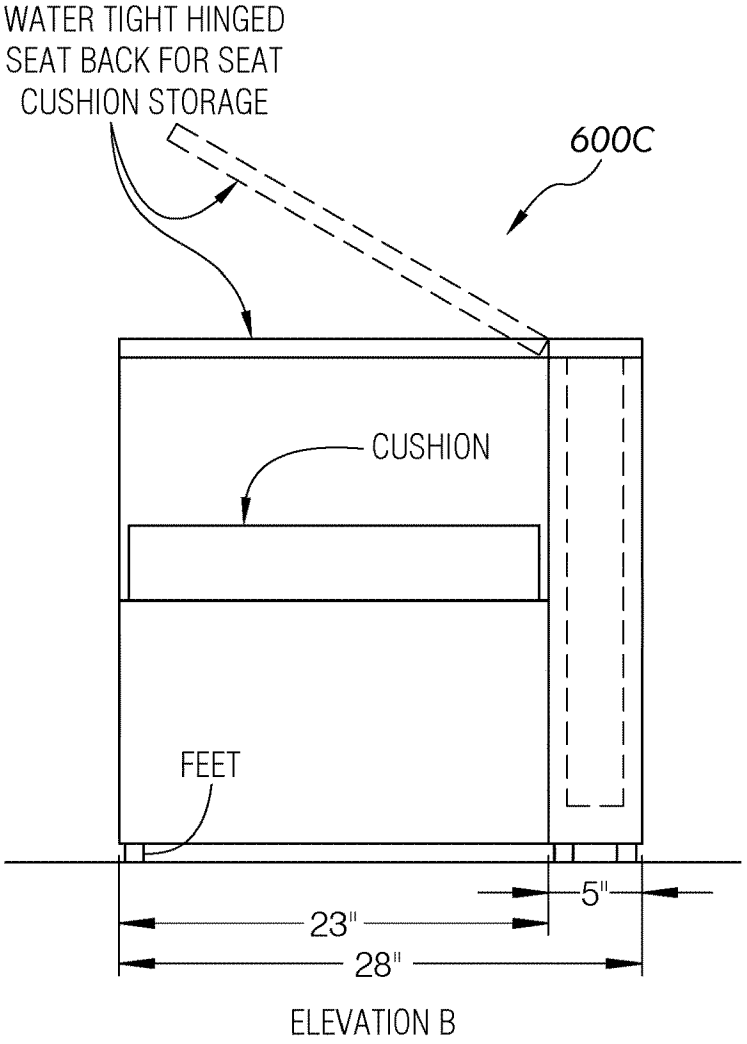

As shown in FIGS. 6B and 6C, a front cross-sectional view of the armless chair can have a general chair shape, with one or more supporting feet or legs, a seating surface, and a first back that is perpendicular to the second back. In the example embodiment, the corner chair has total dimensions of about 28 inches from a bottom edge of the legs that is in contact with a floor, deck, ground, or other supporting surface to an upper surface of the back lids. Legs 640 can provide clearance above the ground with an open space in between, as in the example embodiment there are four legs provided. Legs can be spaced apart and suspend the bottom of the chair above a floor surface. A distance from the bottom edge of the chair legs to the upper seating surface 650 can be about 14 inches. A height of the backs of the chair from can be about 26 inches from the top of the legs or feet to the upward facing surface of the backs of the chair below the back lids.

Each lid 635 is about one inch thick. As shown in the example embodiment, the dining chair internal compart lids are coupled along their widthwise back side edges with one or more hinges that are also coupled to the chair body and allow the lids to be rotated about the hinges. In some embodiments, hinges can be internally positioned, externally positioned, or combinations of both. The dining chair base or exterior shell can be coupled with the internal storage compartment in some embodiments, while in other embodiments the internal storage compartment may rest within a complementary or differently sized space within the external shell. These couplings can be adhesive, mechanical, or others in various embodiments. In many embodiments, the lids can provide a watertight seal for the internal storage compartments and as such, may have one or more internal lips, protrusions or other features.

As shown in FIG. 6D, the corner chair has interior back chambers with dimensions of about 3 inches wide and about 24 inches tall. In some embodiments, an external shell of the corner chair can be a durable powder-coated steel that is covered and coupled with an all-weather resin wicker. This can provide a durable corner chair that is weather resistant and can operable to survive many seasons, while protecting items stored in the internal storage compartments. In some embodiments, corner chairs can be preassembled, while in others, users may assemble one or more components themselves.

FIGS. 7A-7E show an example embodiment of a lounge chair 700A, 700B, 700C, 700D, 700E with integrated storage from top and side cross-sectional views.

Figure 7A:
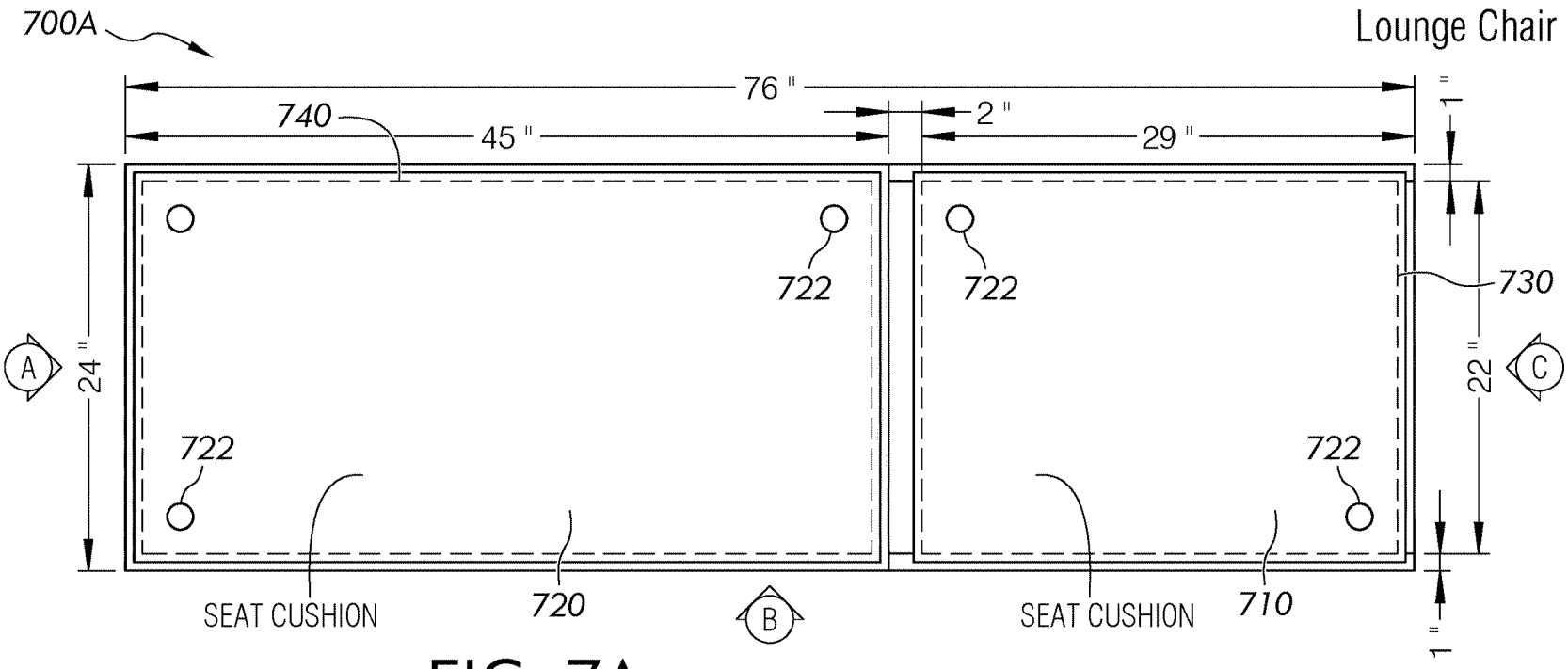
FIGS. 7A-7D show an example embodiment of a lounge chair with integrated storage from top and side cross-sectional views.

As shown in FIG. 7A, an upper surface of the base or bottom portion 720 of the lounge chair can be relatively or completely flat and include an internal compartment 740, indicated by the dashed lines in the figure, which may be sized such that it matches a substantial portion of the surface area of the upper surface of the lounge chair base. The base of the lounge chair can be about 45 inches long and about 24 inches wide and include a second internal compartment. In some embodiments, dimensions of an upper surface of the back 710 of the lounge chair can be about 24 inches wide by about 29 inches long. A combined length of the upper seating surface and upper back surface can be about 76 inches when in a flat orientation, where the upper surfaces are coupled by one or more bars providing about a two-inch clearance between the upper surfaces. Lounge chairs can be various dimensions in different embodiments.

Figure 7B:
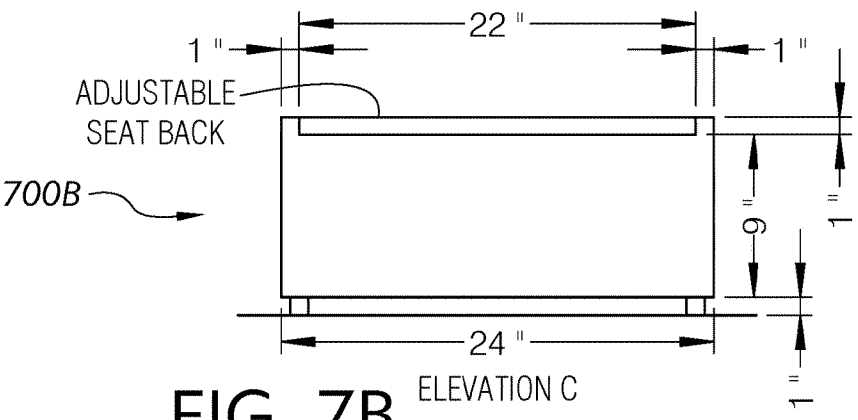

As shown in FIG. 7B, a front cross-sectional view of the lounge chair can have a general lounge chair shape when laid in a flat orientation, with one or more supporting feet or legs, coupled to the seating surface, and to the back. In the example embodiment, the lounge chair has total dimensions of about 22 inches wide and about 11 inches from a bottom edge of the legs that is in contact with a floor, deck, ground, or other supporting surface to an upper surface of the internal compartment lids. The body of the chair may be about 9 inches thick from a lower suspended surface to an upper surface below a chair body lid.

Figure 7C:
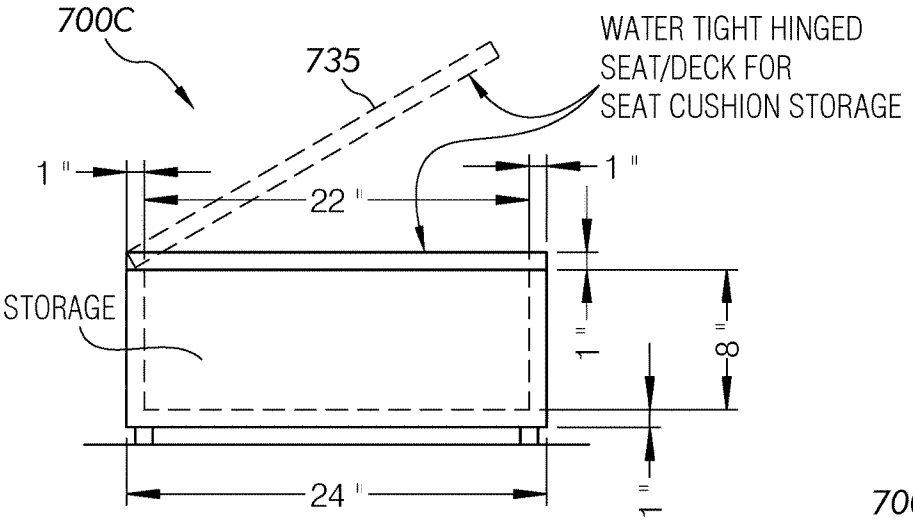
Figure 7D:
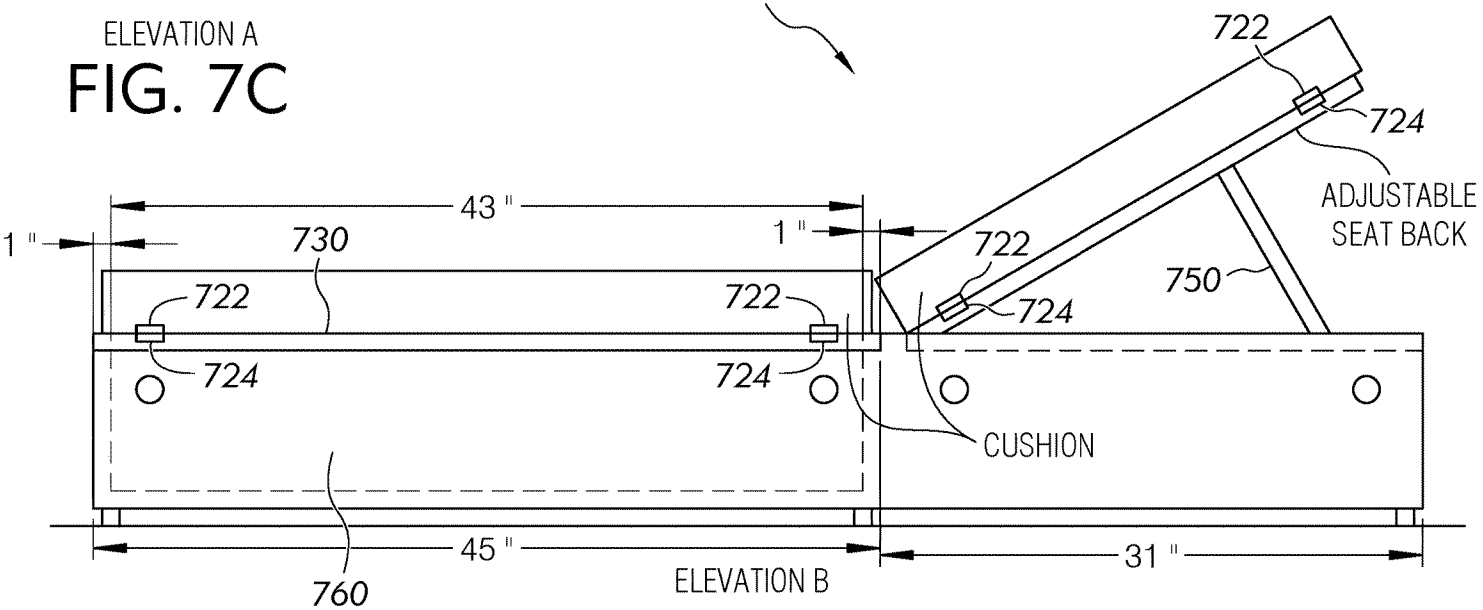

As shown in FIGS. 7C and 7D, the lounge chair can have a first interior chamber 720 with dimensions of about 8 inches deep, 22 inches wide, and about 43 inches long. The lounge chair can have an adjustable back that can be moved using adjustors 750 that is attached at one or more hinges to the base and is operable to rotate about the hinges. The back can be supported by one or more lockable or fixable posts such that users can lay in a reclined position. Legs 760 can provide clearance above the ground with an open space in between, as in the example embodiment there are six legs provided.

The lid 735 can be about one inch thick. As shown in the example embodiment, the lounge chair internal compart lid is coupled along the lengthwise side edge of the base of the lounge chair with one or more hinges that are also coupled to the lounge chair body that allows the lid to be rotated about the hinges. In some embodiments, hinges can be internally positioned, externally positioned, or combinations of both. The lounge chair base or exterior shell can be coupled with the internal storage compartment in some embodiments, while in other embodiments the internal storage compartment may rest within a complementary or differently sized space within the external shell. These couplings can be adhesive, mechanical, or others in various embodiments. In many embodiments, the lids can provide a watertight seal for the internal storage compartments and as such, may have one or more internal lips, protrusions or other features.

Figure 7E:
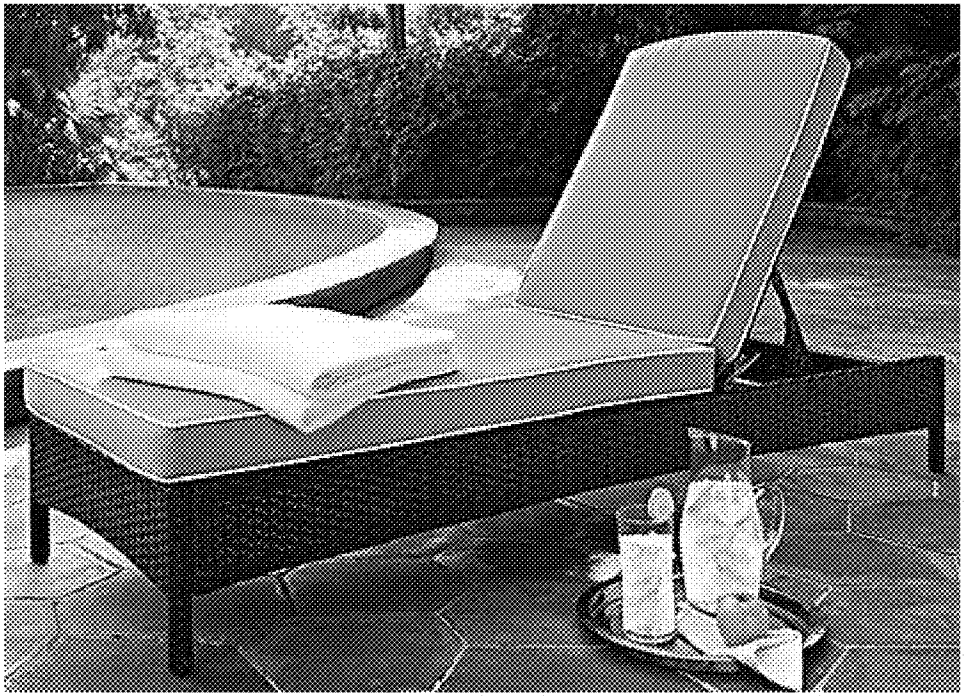
FIG. 7E shows an example embodiment of a lounge chair with integrated storage from a side angled side perspective view.

FIG. 7E shows an example embodiment of a lounge chair with integrated storage from a side angled side perspective view.

In some embodiments, an external shell of the lounge chair can be a durable powder-coated steel that is covered and coupled with an all-weather resin wicker. This can provide a durable lounge chair that is weather resistant and can operable to survive many seasons, while protecting items stored in the internal storage compartments. In some embodiments, lounge chairs can be preassembled, while in others, users may assemble one or more components themselves. In various embodiments, additional features can include white or other trimmed, cushions that are Ultraviolet (UV) resistant or fade resistant. The back can be adjustable to one of a variety of preset or customizable back positions that allow users to lay flat, recline or sit up in different orientations comfortably.

FIGS. 8A-8D show an example embodiment of an ottoman with integrated storage from top and side cross-sectional views.

Figure 8B:
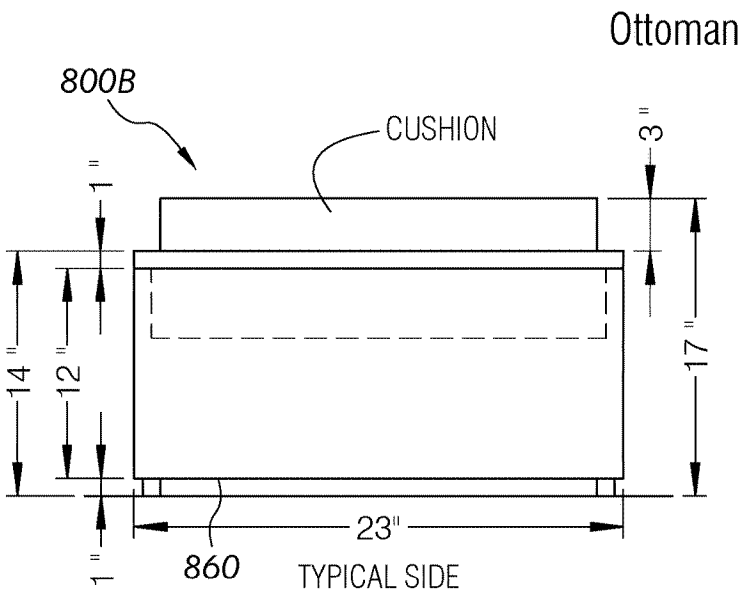
FIGS. 8A-8C show an example embodiment of an ottoman with integrated storage from top and side cross-sectional views.
Figure 8A:
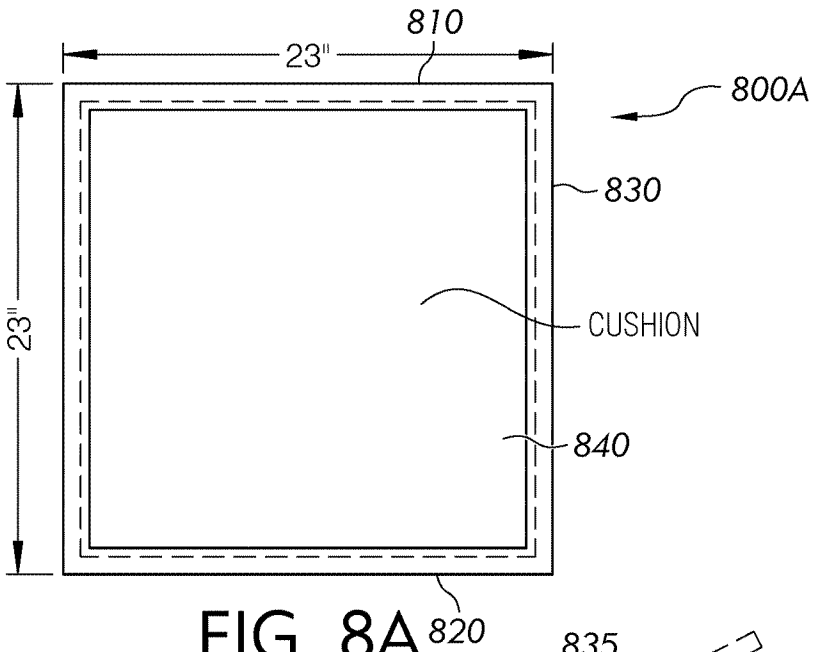

As shown in FIG. 8A, an upper surface 810 of the ottoman can be relatively or completely flat and an internal compartment 840, indicated by the dashed lines in the figure, may be sized such that it matches a substantial portion of the surface area of the upper surface. Ottomans can be various dimensions in different embodiments. In some embodiments, dimensions of an upper surface can be about 23 inches wide by 23 inches long.

As shown in FIG. 8B, a side cross-sectional view of an ottoman can have a box shape, which may extend down to one or more supporting feet or legs 860. In the example embodiment, the ottoman has exterior dimensions of about 12 inches from a lower edge above the legs or feet to an upper edge that is positioned below a sealable lid 835. A distance from a bottom edge of the legs or feet in contact with a floor, deck, ground, or other supporting surface to an upper surface of a lid can be about 14 inches. Cushions 850 can be about 3 inches thick. The lid may have a maximum thickness of slightly less than two inches from an upper surface edge to a surface edge that is flush with an upper surface edge of a wall of the ottoman.

Figure 8C:
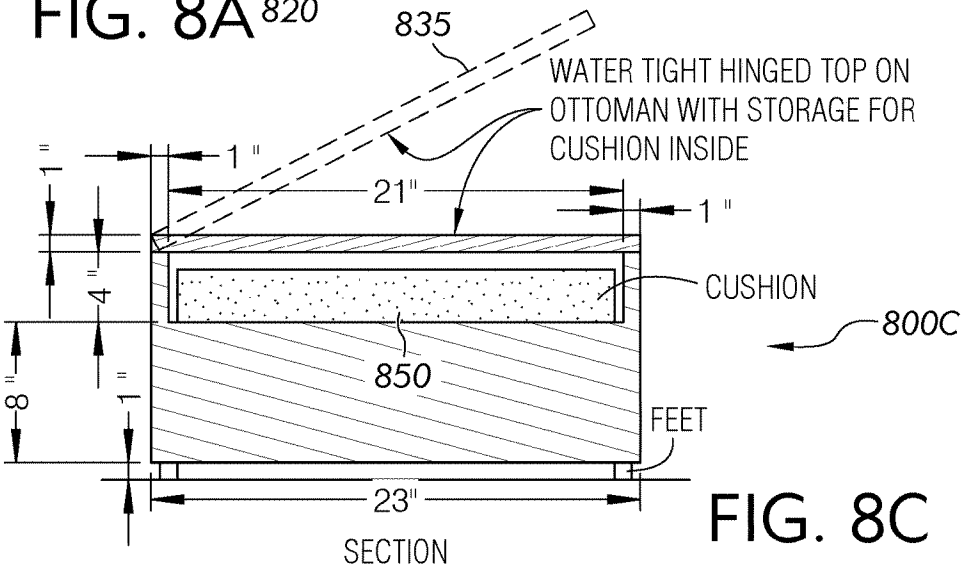

As shown in FIG. 8C, the ottoman has an interior chamber with dimensions of about 4 inches from a supporting internal surface edge with an internal clearance of about 8 inches above an upper internal bottom surface edge of the base of the ottoman. A distance from one or multiple exterior walls of the storage compartment to an internal wall of the base or exterior shell of the ottoman can be about one inch. As shown in the example embodiment, the distance from one internal wall to an opposing internal wall of the internal compartment can be about 21 inches. As shown in the example embodiment, the ottoman can have one side coupled with one or more hinges that are also coupled to the lid and allow the lid to be rotated about the hinges. In some embodiments, hinges can be internally positioned, externally positioned, or combinations of both. The base or exterior shell can be coupled with the internal storage compartment in some embodiments, while in other embodiments the internal storage compartment may rest within a complementary or differently sized space within the external shell. These couplings can be adhesive, mechanical, or others in various embodiments. In many embodiments, the lid can provide a watertight seal for the internal storage compartments and as such, may have one or more internal lips, protrusions or other features.

Figure 8D:
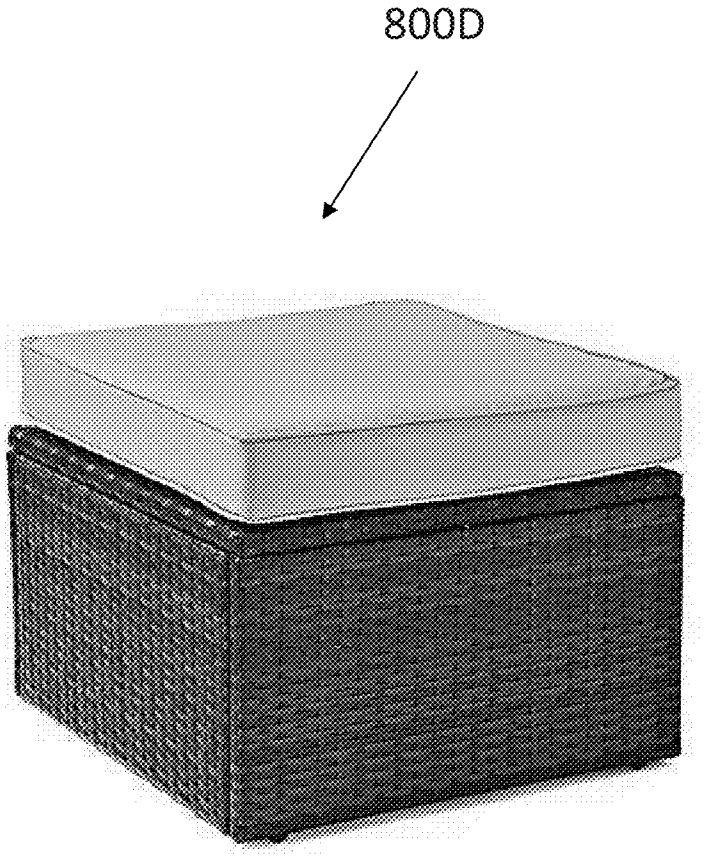
FIG. 8D shows an example embodiment of an ottoman with integrated storage from a side angled side perspective view.

FIG. 8D shows an example embodiment of an ottoman with integrated storage from a side angled side perspective view.

In some embodiments, an external shell of the ottoman can be a durable powder-coated steel that is covered and coupled with an all-weather resin wicker. This can provide a durable ottoman that is weather resistant and can operable to survive many seasons, while protecting items stored in the internal storage compartments. In some embodiments, ottomans can be preassembled, while in others, users may assemble one or more components themselves. In various embodiments, additional features can include white or other trimmed, cushions that are Ultraviolet (UV) resistant or fade resistant.

Figure 9A:
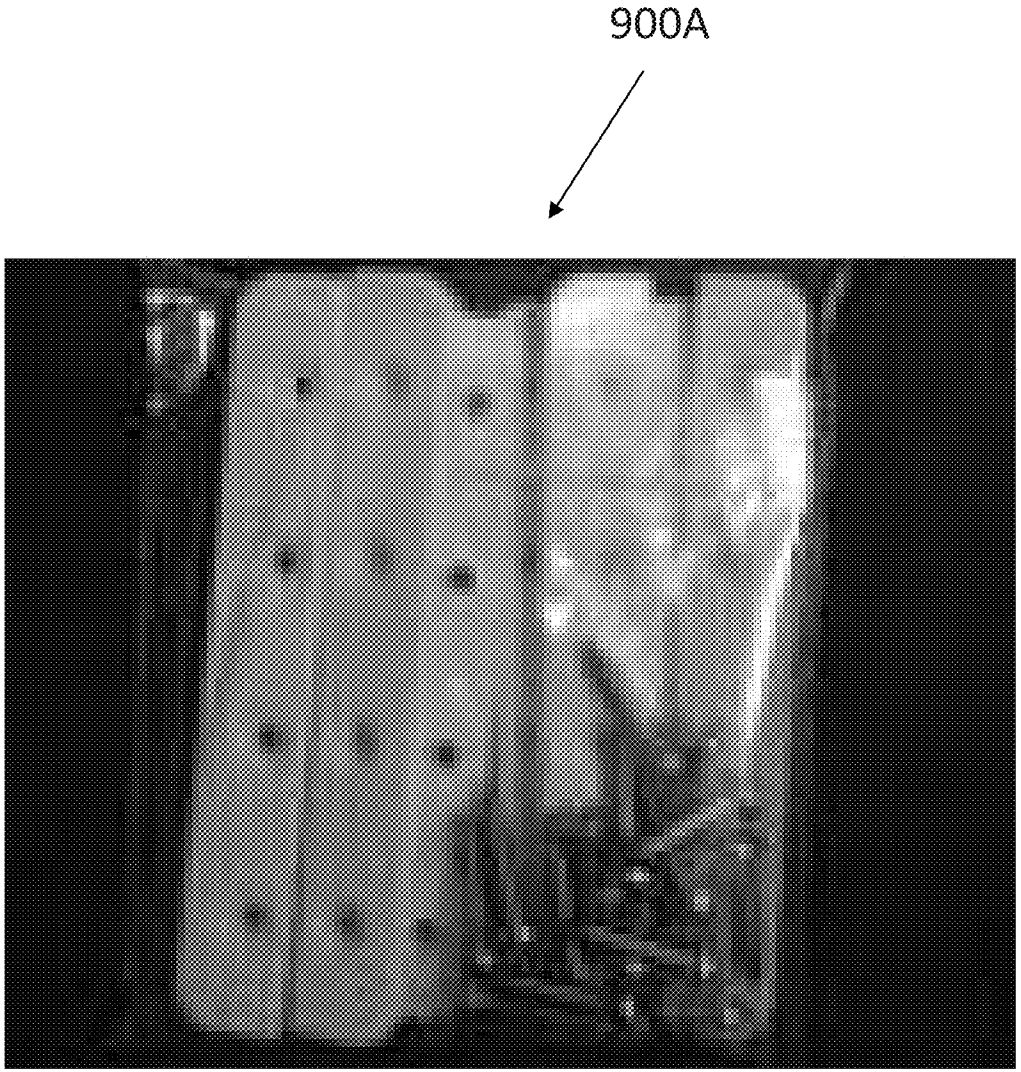
FIG. 9A shows an example embodiment of hinges for coupling components.

FIG. 9A shows an example embodiment of hinges 900*a* for coupling components. As shown in the example embodiment, hinges can be strong, durable, and versatile. These Hinges can cover preset or predrilled hinge holes in surfaces of the various pieces of outdoor furniture and can be secured with one or more screws, nuts, bolts, washers, adhesives, glues, or other appropriate means. In various embodiments, they can be used in hot and cold climates and resist corrosion while providing functionality for long periods of time. As shown, one or more sides of the hinges can have a central coupling such that internal surfaces can rest against each other when closed. Living hinges are also contemplated in some embodiments.

Figure 9B:
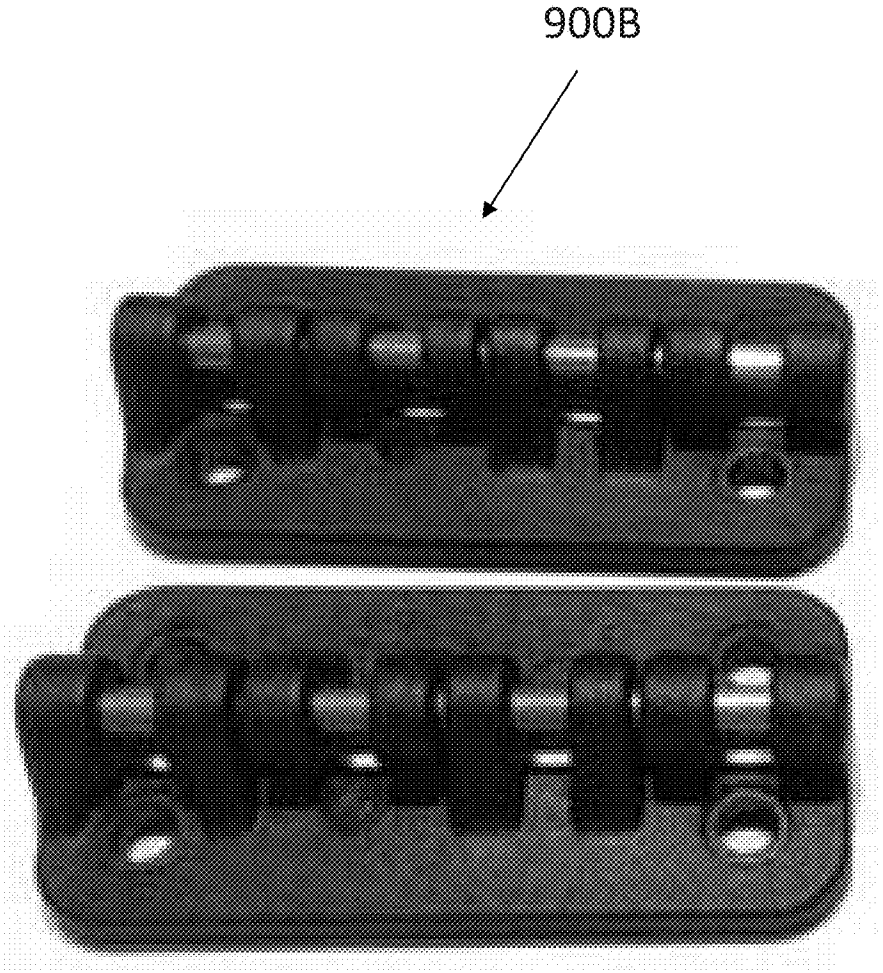
FIG. 9B shows an example embodiment of hinges for coupling components.

FIG. 9B shows an example embodiment of hinges 900B for coupling components. As shown in the example embodiment, halves can be rotatably coupled with each other about a pin or bolt and provide dependability and longevity. One or both of the hinge halves is operable to rotate about the pin and each half can be secured as appropriate with one or more screws, nuts, bolts, washers, adhesives, glues, or other appropriate means.

Figure 10:
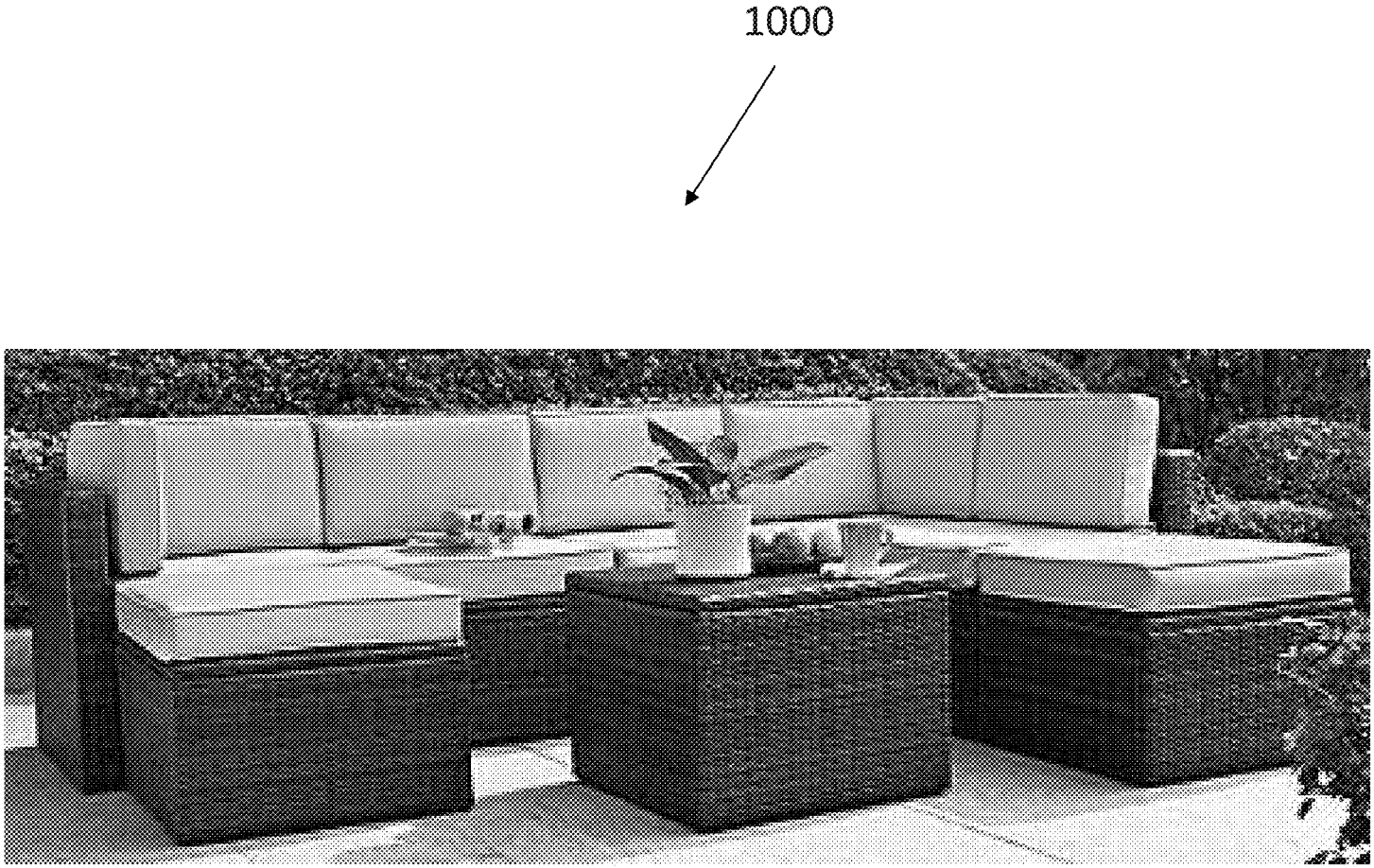
FIG. 10 shows an example embodiment of a full set of outdoor furniture with integrated storage set from a perspective view.

FIG. 10 shows an example embodiment of a full set of outdoor furniture 1000 with integrated storage set from a perspective view. As shown in the example embodiment, various outdoor furniture pieces can have approximate or matching dimensions such that they have uniform seating level surfaces and backs. These pieces can be mixed and matched in different embodiments and can be oriented as desired or appropriate for customization in different outdoor environments.

Figure 11A:
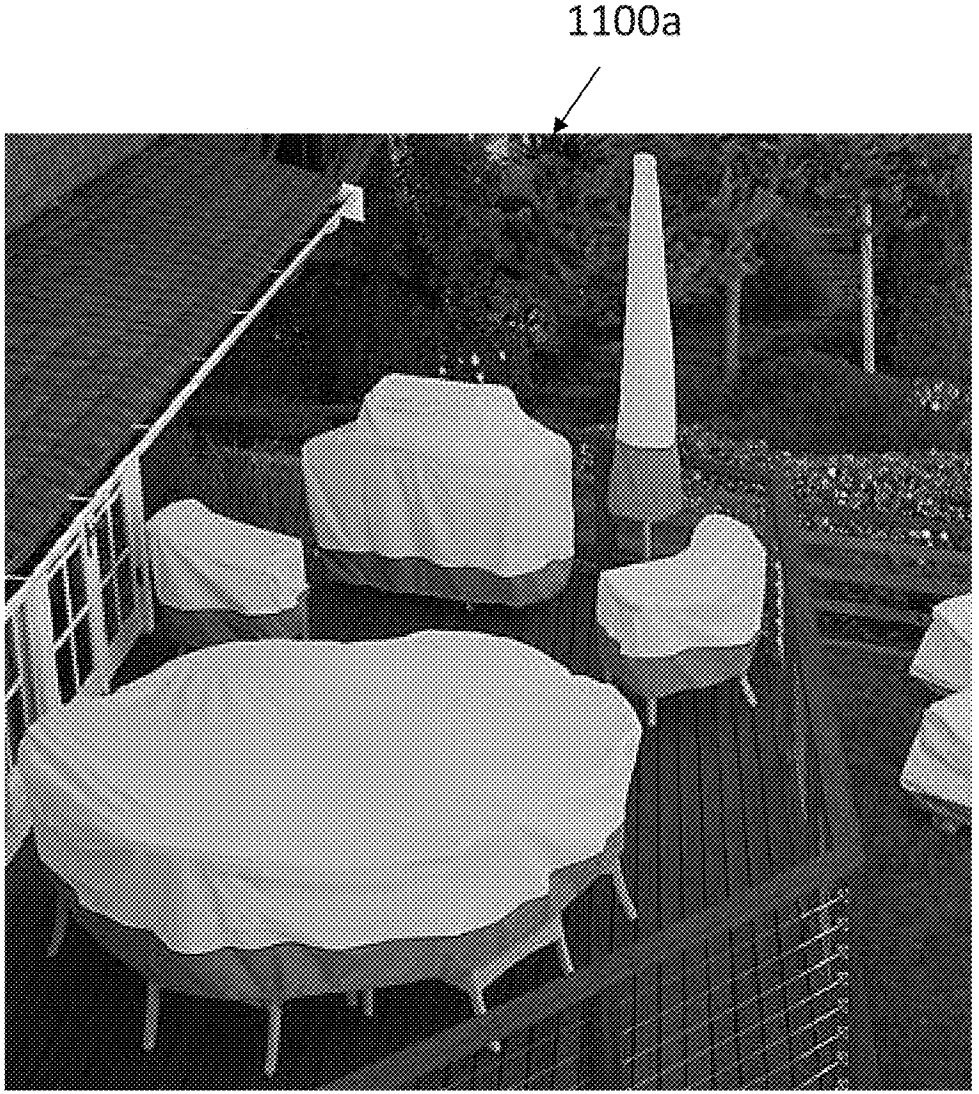
FIG. 11A shows an example embodiment of outdoor furniture with a protective covering from a perspective view.

FIG. 11A shows an example embodiment of outdoor furniture 1100A with a protective covering from a perspective view.

Figure 11B:
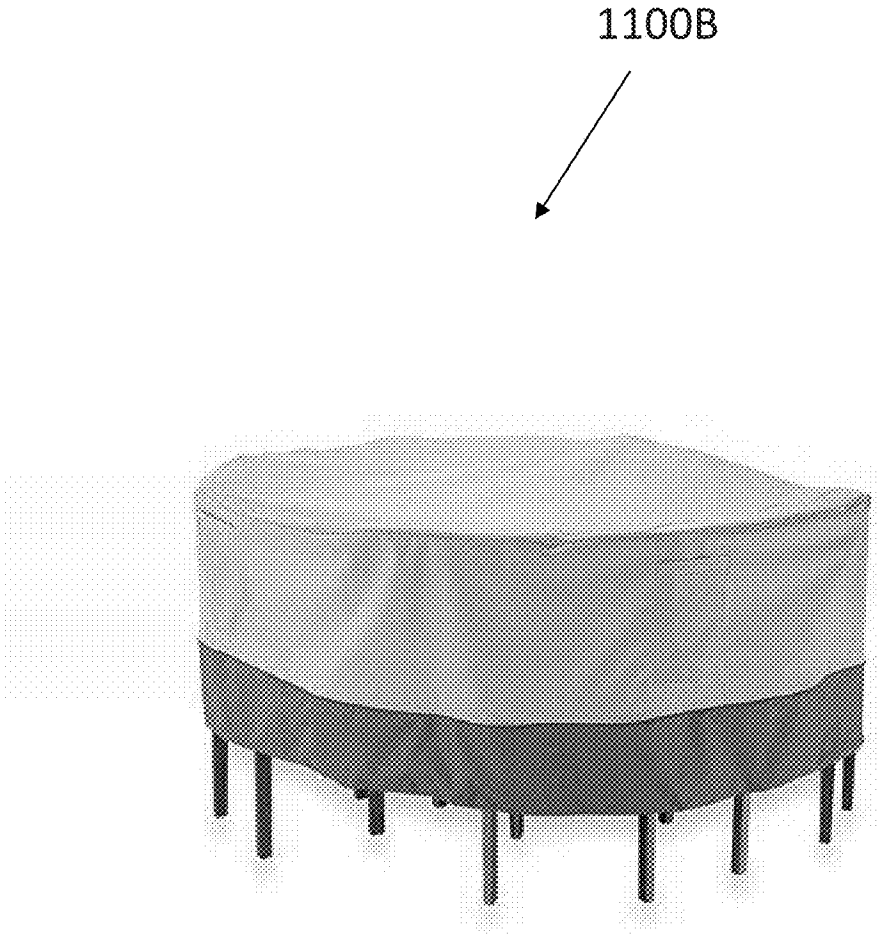
FIG. 11B shows an example embodiment of a table and chairs with a protective covering from a perspective view.

FIG. 11B shows an example embodiment of a table and chairs 1100B with a protective covering from a perspective view.

As is known in the prior art, some outdoor furniture pieces have customized coverings that provide protection from inclement weather that may have zippers, ties, elastic, and other mechanisms to secure them over the furniture pieces. Internal compartments as described herein can provide appropriate storage locations for these coverings when not in use.

Additional outdoor items can also include internal compartments for storage of items, as taught herein. One example is an umbrella, that can be folded and tied when not in use, which may telescope into an umbrella body structure. In some embodiments, pieces of furniture can include pivoting leg areas and cushions that are inflatable or collapsible. Lumbar support pillows can also be stored using internal storage compartments described herein. Securing mechanisms can include keyrings, keys and locks, dog collar types, pin and receiver, latches, electronic locks, remotely operated electronic locks, fingerprint or other sensors, automatic locks, and others. Also contemplated are various seals, rims, ridges, and other features. Some embodiments provide for drainage channels, vents, and other holes to provide airflow and fluid drainage from within internal chambers.

As used herein and in the appended claims, the singular forms "a", "an", and "the" include plural referents unless the context clearly dictates otherwise.

The publications discussed herein are provided solely for their disclosure prior to the filing date of the present application. Nothing herein is to be construed as an admission that the present disclosure is not entitled to antedate such publication by virtue of prior disclosure. Further, the dates of publication provided may be different from the actual publication dates which may need to be independently confirmed.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

What is claimed is:

1. A chair comprising:

a back chamber;

a base chamber;

wherein the back chamber and the base chamber are operatively connected to each other and wherein the back chamber is adjustable in a plane relative to the base chamber such that the back chamber is operable to seat users;

wherein the back chamber and the base chamber further comprise:

an upper portion;

a lower portion;

at least two support walls coupled to the upper portion and lower portion, operable to maintain the upper portion at a height above a ground surface;

at least one moveable component operatively connected to at least one of the upper portion, lower portion, and either of the support walls;

a removable cushion sized to fit on a top surface of the lower portion, wherein at least the base chamber is sized to store the cushion; and wherein the cushion includes one or more internal or external magnets that magnetically couple with one or more magnets of the chair.

2. The chair of claim 1, wherein at least the base chamber is accessible through the at least one moveable component.

3. The chair of claim 1, wherein the at least one moveable component is permanently attached to at least one of upper portion, lower portion, and either of the support walls on at least a portion of at least one edge of at least one of upper portion, lower portion, and either of the support walls.

4. The chair of claim 1, wherein the back chamber has dimensions configured to store at least one cushion that is operable to provide back support to users on the upper portion.

5. The chair of claim 1, wherein the at least one moveable component is configured to hermetically seal at least one of the back chamber and the base chamber.

6. The chair of claim 1, wherein at least one of the back chamber and the base chamber can be made of synthetic materials.

7. The chair of claim 1, wherein at least one of the back chamber and the base chamber can be made of a combination of natural materials and synthetic materials.

8. The chair of claim 1, wherein an external shell of at least one of the upper portion and the lower portion is made of a durable powder-coated steel that is covered and coupled with an all-weather resin wicker.

9. The chair of claim 1, wherein a lower portion of the external shell is lifted from the ground surface.

* * * * *